US006267273B1

(12) United States Patent
Suzuki et al.

(10) Patent No.: US 6,267,273 B1
(45) Date of Patent: Jul. 31, 2001

(54) CONSTANT-VOLUME DISPENSING COATING CONTAINER

(75) Inventors: Kenichi Suzuki, Urawa; Takako Okajima, Gyoda; Yoshiyuki Kakuta, Togane; Riichi Ogawa, Matsudo, all of (JP)

(73) Assignees: Taisho Pharmaceutical Co., Ltd.; Yoshino Kogyosho Co., Ltd., both of Tokyo (JP)

( * ) Notice: Subject to any disclaimer, the term of this patent is extended or adjusted under 35 U.S.C. 154(b) by 0 days.

(21) Appl. No.: 09/600,626

(22) PCT Filed: Jan. 20, 1999

(86) PCT No.: PCT/JP99/00185

§ 371 Date: Jul. 20, 2000

§ 102(e) Date: Jul. 20, 2000

(87) PCT Pub. No.: WO99/37551

PCT Pub. Date: Jul. 29, 1999

(30) Foreign Application Priority Data

Jan. 23, 1998 (JP) ..... 10-010922
Jan. 23, 1998 (JP) ..... 10-010923
Jan. 19, 1999 (JP) ..... 11-010007

(51) Int. Cl.[7] ..... B67D 3/00

(52) U.S. Cl. ..... 222/505

(58) Field of Search ..... 222/506, 505, 222/521, 531, 91, 83

(56) References Cited

FOREIGN PATENT DOCUMENTS 2-97251 8/1990 (JP) .
6-35153 5/1994 (JP) .

*Primary Examiner*—Philippe Derakshani
*Assistant Examiner*—Thach H Bui
(74) *Attorney, Agent, or Firm*—Armstrong, Westerman, Hattori, McLeland & Naughton, LLP

(57) ABSTRACT

An object of the invention is to measure out precisely the liquid to be poured out and applied, to safely achieve the firm assembly of components and to obtain effective function of displays. An applying stopper (1), which changeovers communication of a measuring chamber (A) formed by rotational operation between a bottle unit (8) and a pouring out mouth (55), is attached to a bottle unit (8). The measuring chamber (A) is structured by parts that cannot be deformed. Inseparable assembling of an attaching unit (2) and a switching unit (4) of the applying stopper (1) is achieved by bending displacement of engagement coupling function parts. An assembling position of the applying stopper (1) with respect to the bottle unit (8) in the circumferential direction is aligned.

18 Claims, 23 Drawing Sheets

CONSTANT-VOLUME DISPENSING COATING CONTAINER

TECHNICAL FIELD

The present invention relates to a vessel for liquid such as medicated hair growth tonic which is expensive and an amount of thereof poured out and used in one operation is made to be constant, more particularly, to a vessel in which an mount of liquid poured out in one pouring out/applying operation is automatically measured out to a certain amount.

BACKGROUND OF THE INVENTION

As a pouring out and applying stopper used in this kind of the constant amount pouring out and applying vessel, the Applicant has already proposed the invention according to JP-U-6-35153.

In this prior art, a combination of a switching unit and an operating unit, which form a measuring chamber and has an opening/closing valve unit assembled at a pouring out mouth and isolates the measuring chamber from a bottle unit by a tight contact of the switching unit against a sealing outer flange at an ascending limit, is tightly and vertically displaceably attached to an attaching unit, which is tightly and immovably attached to the bottle unit and is provided with a stopper unit having the sealing outer flange and a sealing top surface. In a usable state, only an amount of liquid which has been measured to be a suitable amount can be poured out and a wasteful pouring out of the liquid contained is prevented.

The switching unit is attached to the attaching unit in vertically displaceable by putting a threaded tube into threaded engagement with an attaching tube and in inseparable from the attaching unit by the fact that an abutting ridge of the switching unit abuts against a stop ridge of the attaching unit from underside at the ascending limit.

At a descending limit of the switching unit, a lower surface of a valve seat of a valve unit comes into contact with the sealing top surface of the stopper unit, and thereby downward displacement of the valve unit is prevented by the stopper unit in an unused state of the vessel. Therefore, even when an abnormal pressing force is exerted on an upper end of a valve head protruding from the pouring out mouth, the valve unit is not opened, and a closed state of the bottle unit is remained.

In the above-described prior art, the opening/closing valve unit is structured as follows. The valve head is fitted in the pouring out mouth of the operating unit in such a manner that it is vertically movable capable of protruding from the mouth and is provided with vertical grooves notched on its outer circumference surface. A valve seat, which can come into close contact with a lower periphery of the pouring out mouth of the operating unit, is provided at a lower end of the valve head. A plurality of helical elastic elements giving an upward elastic force are connected to the valve seat at their upper ends and to the switching unit at their lower ends.

Therefore, the opening/closing valve unit is assembled in such a manner that about lower half portion of each elastic element is located in the measuring chamber under the compressed condition so as to give an upward elastic force, i.e., under the condition in which each elastic element is vertically pressed and is elastically deformed.

Because a part of capacity of the measuring chamber is occupied by the plurality of elastic elements, an actual capacity of the measuring chamber is varied by a slight change in the form of elastic deformation of these elastic elements. Therefore, there is a problem that it is difficult to correctly square an amount of the actually measured liquid with a predetermined amount.

When the switching unit is assembled to the attaching unit, an abutting ridge disposed around a lower end of an inner circumference surface of the switching unit must be forcibly gotten over a helical ridge and a stop ridge on an outer circumference surface of an attaching tube to be threadedly engaged with the attaching unit. Therefore, there is fear that the above-described ridges may be deformed. Further, there is a problem that if the height of the abutting ridge is made low in order to prevent occurrence of the deformation, an escape-preventing function of the abutting ridge becomes possibly insufficient.

There is another problem that it is impossible to enhance feeling of use by providing at a portion of the abutting ridge of the switching unit a thin sounding piece, which, at the ascending and descending limits of the switching unit, goes over a vertical ridge provided on an outer circumference surface of the attaching unit to generate a click sound.

This is because there is a large possibility that the sounding piece may be broken when it goes over the helical ridge and the stop ridge upon attaching the switching unit to the attaching unit.

There is still another problem. If the threaded engagement of the switching unit to the attaching unit is made tight by rotating the operating unit excessively, the valve seat of the valve unit, which goes down together with the switching unit and the operating unit, is strongly sandwiched between a lower edge of the pouring out mouth of the operating unit and the sealing top surface of the stopper unit. In that case, there was a fear that the valve seat may get deformation or some other damages, and may lose its sealing function.

Moreover, it is not regulated so that a position of attachment of the applying stopper with respect to the bottle unit in the circumferential direction becomes constant. Therefore, even if a display for opening/closing position may be marked on the applying stopper for the convenience of handling, it is almost impossible to exactly position the display with respect to the bottle unit. Accordingly, there is a problem that it is not possible to effectively put into function the pre-marked display of the opening/closing position.

That is, when a front/rear relationship is given to an attitude of the bottle unit by displaying a merchandise name on one side and usage directions on the other side of the bottle unit, there is a need to adapt positions of displays on the applying stopper, such as the opening/closing position display or an action position display, to the front/rear positional relationship of the bottle unit for the convenience of handling and for effective display function. However, unless the positional relationship in the circumferential direction between the bottle unit and the applying stopper is controlled so as to take a fixed position, it is impossible to adapt the displays effected on the applying stopper to the front/rear positional relationship of the bottle unit.

Thus the invention are made to solve these problems found in the above-described prior art. A technical subject matter of the present invention is to get rid of any change in capacity of the measuring chamber, which may be caused by the change in the form of elastic deformation of the opening/closing valve unit, and thereby an object of the invention is to make it always possible for the liquid contained in the bottle unit to be measured and poured out precisely.

Another technical subject matter of the present invention is that assembling of the switching unit to the attaching unit is achieved naturally, safely and firmly and thereby an object of the present invention is to readily obtain a stable and firm assembling and also a favorable feeling for use.

Still another technical subject matter of the present invention is to fix the circumferential position of attachment of the applying stopper with respect to the bottle unit at one fixed position, and thereby an object of the invention is to make effective use of the displays on the applying stopper and to obtain correct and favorable handling of the vessel.

DISCLOSURE OF THE INVENTION

The invention according to claim 1 comprises:

a bottle unit having a mouth tube on top thereof;

an applying stopper, which comprises an attaching unit, which is tightly and immovably attached to the mouth tube of the bottle unit and is provided with a stopper unit having a sealing outer flange in an open upper end of a central portion;

a switching unit, which is fitted tightly and vertically displaceably onto said attaching unit, is provided with an inner tube stood at a central portion so that said sealing outer flange tightly fits into a top end opening at an ascending limit for said switching unit;

an operating unit of a cylindrical shape having a top plate, which is fitted tightly and immovably onto said switching unit, and is provided with a pouring out mouth at an upper end, said operating unit defining a measuring chamber of a certain volume together with said switching unit; and a valve unit, which is provided with a valve head fitted into said pouring out mouth in such a manner that an upper end portion thereof can protrude from said mouth and a valve seat provided around a lower end of said valve head and coming into close contact with a lower end opening portion of said pouring out mouth, said valve unit giving an upward elastic force to an integrated member of said valve seat and said valve head; and a cap unit, which covers said applying stopper and is removably fitted onto an upper end of a barrel portion of said bottle unit;

wherein said valve unit further comprises a plurality of fixing plates stood on a top surface of an attaching ring which is immovably attached to the switching unit, and a plurality of helical elastic elements interconnecting said fixing plates and said valve seat, said fixing plates having a height substantially the same as a depth of the measuring chamber.

In an unused state, i.e., in a measuring state in which a combination of the switching unit and the valve unit and the operating unit is located at a descending limit, the pouring out mouth of the operating unit is closed by the valve unit. At the same time, the sealing outer flange of the stopper unit of the attaching unit is located above the inner tube of the switching unit, and a gap is formed between the sealing outer flange and the inner tube. Therefore, the measuring chamber formed between the switching unit and the operating unit is in communication with an inside of the bottle unit.

To pour out and apply a constant amount of the contained liquid from this state, first, the bottle unit is turned upside down to allow the liquid to flow from the bottle unit to the measuring chamber, and then the bottle unit is returned to the upright position to let the constant amount of the liquid remain in the measuring chamber.

Then, the operating unit is operated to move the combination of the switching unit, the valve unit and the operating unit up to the ascending limit, relative to a combination of the attaching unit and the stopper unit.

Due to this upward displacement, the sealing outer flange of the stopper unit tightly fits into the upper opening of the inner tube of the switching unit. As a result, the measuring chamber is disconnected from the bottle unit inside, and the vessel becomes in an usable state allowing for liquid application.

Once the applying stopper is in the applying state, the bottle unit is turned upside down, and the valve head projected from the pouring out mouth of the operating unit is pressed down onto a surface to be applied, such as human head skin.

When the valve head is pressed against the surface to be applied, it is pushed into the pouring out mouth, and the mouth is opened. The constant amount of the liquid in the measuring chamber is discharged and is applied to the surface.

During the application of the liquid to the surface, no liquid runs out of the bottle unit because the bottle unit is in the closed state since the sealing outer flange fits tightly into the upper opening of the inner tube of the switching unit.

That is, only the constant amount of the liquid that has been measured out in the measuring chamber is applied onto the surface.

After liquid application is completed, the bottle unit is detached from the surface, and is restored to its upright position, and the combination of the switching unit, the valve unit and the operating unit is brought back to the descending limit.

With the separation of the vessel from the surface, the valve head returns to its original position by means of the elastic force from the elastic elements, so that the pouring out mouth is closed. As the combination of the switching unit, the valve unit and the operating unit goes back to the descending limit, the connection between the measuring chamber and the bottle unit inside is restored, and the vessel returns to the measuring state.

The helical elastic elements of the valve unit are fixed to top ends of the fixing plates stood at a height substantially equal to the depth of the measuring chamber. Therefore, these elastic elements are not located in the measuring chamber, so that there is little possibility that they affect the capacity of the measuring chamber. Thus, the precise specified amount of the liquid can always be measured out and applied.

The invention according to claim 2 comprises:

a bottle unit having a mouth tube on top thereof;

an applying stopper, which comprises an attaching unit, which is tightly and immovably attached to the mouth tube of the bottle unit and is provided with a stopper unit having a sealing outer flange in an open upper end of a central portion;

a switching unit, which is tightly fitted onto said attaching unit so as to move upward and downward by threaded engagement and is provided with an inner tube stood at a central portion so that said sealing outer flange tightly fits into a top end opening at ascending limit for said switching unit;

an operating unit of a cylindrical shape having a top plate, which is fitted tightly and immovably onto said switching unit, and is provided with a pouring out mouth at an upper end, said operating unit defining a measuring chamber of a certain volume together with said switching unit; and a valve unit, which is provided with a valve head fitted into said pouring out mouth in such a manner that an upper end portion thereof can protrude from said mouth and a valve seat provided around a lower end of said valve head and coming into close contact with a lower end opening portion of said pouring out mouth, said valve unit giving an upward elastic force to an integrated member of said valve seat and said valve head; and a cap unit, which covers said applying stopper and is removably fitted onto an upper end of a barrel portion of said bottle unit;

wherein a plurality of escape-preventing pieces, inside portions of which are formed to abutting convex portions, connected to a lower end of said switching unit through thin portions in such a manner that the pieces can be bent and are in a spread state, the pieces being bent inwardly when the operating unit is attached to said switching unit, and at the ascending limit, the abutting convex portions abutting against a stop ridge on a circumference of the attaching unit from underside.

In the process of assembling the vessel for pouring out and applying a constant amount of liquid according to the invention, the switching unit is smoothly fitted onto the attaching unit without that the abutting convex portions on the pieces come into contact with the stop ridge or helical ridge of the attaching unit, because the plurality of escape-preventing pieces on the lower periphery of the switching unit are connected in the spread state.

Thereafter, the operating unit is forcibly pushed onto the switching unit, so that each of the escape-preventing pieces is bent at the thin portions and pushed inwardly by a lower end surface of the operating unit. In that state, the switching unit can be inhibited to get away from the attaching unit.

The invention according to claim 3 comprises the following feature in addition to the invention according to claim 2. At least one sounding piece, an inside of which is formed to be an surmountable convex, is connected to the lower periphery of the switching unit through a thin portion in such a manner that it can be bent and a lower portion of the piece protrudes outwardly. The sounding piece is bent inwardly when the operating unit is fitted onto the switching unit. The surmountable convex of the sounding piece is allowed to go over vertical ridges on an outer circumference of the attaching unit to result clicking sound just before the ascending limit and the descending limit of the switching unit.

The invention according to claim 4 comprises the following feature in addition to the invention according to claim 2. A plurality of escape-preventing pieces, insides of which are formed to be abutting convex portions, and a sounding piece, inside of which is formed to be a surmountable convex portion are connected to the lower periphery of the switching unit through thin portions in such a manner that the pieces can be bent and lower portions of the pieces protrude outwardly. A clicking ridge is provided on an inner end surface of an abutting convex portion of one of the escape-preventing pieces which is located at the position symmetrical to the click sounding piece with respect to a central axis. These escape-preventing pieces and the sounding piece are bent inwardly when the operating unit is fitted onto the switching unit. The surmountable convex portion and the clicking ridge are allowed to go over vertical ridges on an outer circumference of the attaching unit to result a clicking sound and give click feeling just before the ascending limit and the descending limit of the switching unit.

In the inventions according to claims 3 and 4, the switching unit is smoothly fitted onto the attaching unit without that the plurality of escape-preventing pieces and the sounding piece come into contact with the stop ridge or helical ridge of the attaching unit, because the plurality of escape-preventing pieces and the sounding piece on the lower periphery of the switching unit are connected in the spread state.

In a state in which the switching unit has been fitted onto the attaching unit, when the operating unit is forcibly fitted onto the switching unit, the escape-preventing pieces and the sounding piece are bent at respective thin portions and are pushed inwardly. In that state, the switching unit can be inhibited to escape from the attaching unit.

When the surmountable convex of the sounding piece and the clicking ridge of the one escape-preventing piece go over the vertical ridges on the attaching unit, a click sound and click feeling are resulted, at which one can be sure accurately that the applying stopper has reached the measuring state or the applying state. This takes place just before the ascending limit of the switching unit, i.e., just before the applying state in which the pouring out mouth can be opened by pressing down the valve head; or just before the descending limit, i.e., just before the measuring state in which the pouring out mouth is tightly closed and cannot be opened, and in turn, the measuring chamber is connected to the bottle unit inside.

The invention according to claim 5 comprises:

a bottle unit having a mouth tube on top thereof;

an applying stopper, which comprises an attaching unit, which is tightly and immovably attached to the mouth tube of the bottle unit and is provided with a stopper unit having a sealing outer flange in an open upper end of a central portion;

a switching unit, which is fitted tightly onto said attaching unit so as to move upwardly and downwardly with a certain stroke in relative rotational movement and is provided with an inner tube stood at a central portion so that said sealing outer flange tightly fits into a top end opening at ascending limit of said switching unit;

an operating unit of a cylindrical shape having a top plate, which is fitted tightly and immovably onto said switching unit, and is provided with a pouring out mouth at an upper end, said operating unit defining a measuring chamber of a certain volume together with said switching unit; and a valve unit, which is provided with a valve head fitted into said pouring out mouth in such a manner that an upper end portion thereof can protrude from said mouth and a valve seat provided around a lower end of said valve head and coming into close contact with a lower end opening portion of said pouring out mouth, said valve unit giving an upward elastic force to an integrated member of said valve seat and said valve head; and a cap unit, which covers said applying stopper and is removably fitted onto an upper end of a barrel portion of said bottle unit;

wherein a vacant zone is formed on an outer circumference surface of said mouth tube at a certain position in a circumferential direction between a vertical stop ridge and one end of a circumferential ridge, the other end of which is connected to said vertical stop ridge; and wherein a vertical control ridge is disposed on an upper part of an inner circumference surface of an attaching tube which is a main part of said attaching unit, said vertical control ridge abutting against said vertical stop ridge in the circumferential direction and against the circumferential ridge from upside but fitting into said vacant zone with almost no gap when said attaching tube is fitted onto said mouth tube.

As the attaching tube of the attaching unit is fitted onto the mouth tube of the bottle unit, the vertical control ridge abuts against the circumferential ridge and the attaching operation is stopped halfway. When this occurs, the attaching unit is rotated relative to the bottle unit in a certain direction. During this rotation, the vertical control ridge abuts against the vertical stop ridge. At that time, the vertical control ridge is released from the stoppage by the circumferential ridge, and faces the vacant zone, so that the vertical control ridge can fit into the vacant zone. Thus, at the position where the vertical control ridge faces the vacant zone, the fitting of the attaching tube onto the mouth tube is resumed, and the attaching unit is completely attached to the bottle unit.

Thus, the attachment of the attaching unit to the mouth tube of the bottle unit is achieved by allowing the vertical control ridge to fit into the vacant zone. As a result, the position at which the attaching unit is attached to the bottle unit is controlled to a certain position on the circumference of the attaching unit. For this reason, an attaching position of the attaching unit with respect to the bottle unit in the circumferential direction, in other words, an attitude of the applying stopper attached on the bottle unit in the circumferential direction becomes always constant.

The invention according to claim 6 comprises:

a bottle unit having a mouth tube on top thereof;

an applying stopper, which comprises an attaching unit, which is tightly and immovably attached to the mouth tube of the bottle unit and is provided with a stopper unit having a sealing outer flange in an open upper end of a central portion;

a switching unit, which is fitted tightly onto said attaching unit so as to move upwardly and downwardly with a certain stroke in relative rotational movement and is provided with an inner tube stood at a central portion so that said sealing outer flange tightly fits into a top end opening at ascending limit for said switching unit;

an operating unit of a cylindrical shape having a top plate, which is fitted tightly and immovably onto said switching unit, and is provided with a pouring out mouth at an upper end, said operating unit defining a measuring chamber of a certain volume together with said switching unit; and a valve unit, which is provided with a valve head fitted into said pouring out mouth in such a manner that an upper end portion thereof can protrude from said mouth and a valve seat provided around a lower end of said valve head and coming into close contact with a lower end opening portion of said pouring out mouth, said valve unit giving an upward elastic force to an integrated member of said valve seat and said valve head; and a cap unit, which covers said applying stopper and is removably fitted onto an upper end of a barrel portion of said bottle unit;

wherein at least an upper tube of the operating unit is made transparent or translucent so that the liquid inside the measuring chamber is visible from outside.

In the invention according to claim 6, the measured liquid inside the measuring chamber can be checked visually from outside so that the liquid can be poured out and applied precisely and with assurance.

The invention according to claim 7 comprises:

a bottle unit having a mouth tube on top thereof;

an applying stopper, which comprises an attaching unit, which is tightly and immovably attached to the mouth tube of the bottle unit and is provided with a stopper unit having a sealing outer flange in an open upper end of a central portion;

a switching unit, which is fitted tightly onto said attaching unit so as to move upwardly and downwardly with a certain stroke in relative rotational movement and is provided with an inner tube stood at a central portion so that said sealing outer flange tightly fits into a top end opening at ascending limit for said switching unit;

an operating unit of a cylindrical shape having a top plate, which is fitted tightly and immovably onto said switching unit, and is provided with a pouring out mouth at an upper end, said operating unit defining a measuring chamber of a certain volume together with said switching unit; and a valve unit, which is provided with a valve head fitted into said pouring out mouth in such a manner that an upper end portion thereof can protrude from said mouth and a valve seat provided around a lower end of said valve head and coming into close contact with a lower end opening portion of said pouring out mouth, said valve unit giving an upward elastic force to an integrated member of said valve seat and said valve head; and a cap unit, which covers said applying stopper and is removably fitted onto an upper end of a barrel portion of said bottle unit;

wherein said stopper unit is immovably fixed on an upper end of an erect tube which is stood to form an upper end of an opened central part of said attaching unit; and wherein a projected stopper piece, which can be inserted into a vertical hole provided in said valve head, is stood at a center of a sealing top surface, which is an upper surface coming into contact with a lower surface of a valve head of said valve unit.

In the invention according to claim 7, at an initial period of switching from the measuring state to the applying state, i.e., in an initial period of rotation and ascending displacement of a combination of the switching unit, operating unit and valve unit, the stopper unit does not rotate together with the valve unit, but rotates relative to the stopper unit. Accordingly, occurrence of trouble that the stopper unit and the valve unit adhere to each other and the pouring out mouth is wrongly opened is prevented.

The invention according to claim 8 comprises:

a bottle unit having a mouth tube on top thereof;

an applying stopper, which comprises an attaching unit, which is tightly and immovably attached to the mouth tube of the bottle unit and is provided with a stopper unit having a sealing outer flange in an open upper end of a central portion;

a switching unit, which is fitted tightly onto said attaching unit so as to move upwardly and downwardly with a certain stroke in relative rotational movement and is provided with an inner tube stood at a central portion so that said sealing outer flange tightly fits into a top end opening at ascending limit for said switching unit;

an operating unit of a cylindrical shape having a top plate, which is fitted tightly and immovably onto said switching unit, and is provided with a pouring out mouth at an upper end, said operating unit defining a measuring chamber of a certain volume together with said switching unit; and a valve unit, which is provided with a valve head fitted into said pouring out mouth in such a manner that an upper end portion thereof can protrude from said mouth and a valve seat provided around a lower end of said valve head and coming into close contact with a lower end opening portion of said pouring out mouth, said valve unit giving an upward elastic force to an integrated member of said valve seat and said valve head; and a cap unit, which covers said applying stopper and is removably fitted onto an upper end of a barrel portion of said bottle unit;

wherein a height of a lower half of an outer circumference surface of the valve head of the valve unit, with which a lower end part of a circumference surface of the pouring out mouth of said operating unit tightly and slidingly comes into contact, is set nearly equal to a movement in a direction of height of the inner tube of said switching unit until the inner tube positioned at the descending limit tightly fits onto a sealing outer flange of said stopper unit.

In the invention according to claim 8, in a range of descending/ascending displacement of switching between the measuring state and the applying state, during a lower half range, in which the inner tube of the switching unit and the sealing outer flange of the stopper unit are separated, close of the pouring out mouth by the valve head of the valve unit is kept and a state in which liquid other than the measured out liquid is poured out is surely prevented, and during an upper half range, in which the sealing outer flange of the stopper unit is tightly fitted into the inner tube of the switching unit, opening of the pouring out mouth by the valve head of the valve unit is possible and only the measured out liquid can be poured out.

The invention according to claim 9 comprises:

a bottle unit having a mouth tube on top thereof;

an applying stopper, which comprises an attaching unit, which is tightly and immovably attached to the mouth tube of the bottle unit and is provided with a stopper unit having a sealing outer flange in an open upper end of a central portion;

a switching unit, which is fitted tightly onto said attaching unit so as to move upwardly and downwardly with a certain stroke in relative rotational movement and is provided with an inner tube stood at a central portion so that said sealing outer flange tightly fits into a top end opening at ascending limit for said switching unit;

an operating unit of a cylindrical shape having a top plate, which is fitted tightly and immovably onto said switching unit, and is provided with a pouring out mouth at an upper end, said operating unit defining a measuring chamber of a certain volume together with said switching unit; and a valve unit, which is provided with a valve head fitted into said pouring out mouth in such a manner that an upper end portion thereof can protrude from said mouth and a valve seat provided around a lower end of said valve head and coming into close contact with a lower end opening portion of said pouring out mouth, said valve unit giving an upward elastic force to an integrated member of said valve seat and said valve head; and a cap unit, which covers said applying stopper and is removably fitted onto an upper end of a barrel portion of said bottle unit;

wherein the stopper unit comprises a fitting portion of a thin cylindrical shape provided with ceiling; a sealing outer flange provided in a circumferential direction at a center of an outer circumference surface of said fitting portion; and a projected stopper piece of an upright thin rod shape, which is erected from a center of a flat sealing top surface; and wherein a vertical hole extending vertically is provided at a center of the valve head of said valve unit in such a manner that the vertical hole forms a gap between the valve head and the projected stopper piece for allowing air to pass therethrough, and wherein a part of a lower surface of said valve head opposite to said flat sealing top surface is a flat surface which comes in tight contact with said sealing top surface.

In the invention according to claim 9, the sealing top surface of the stopper unit is in close contact with the lower surface of the valve head of the valve unit and the vertical hole provided in the valve head of the valve unit is closed and the pouring out mouth is in a completely closed state in the measuring state in which the pouring out mouth of the operating unit has been sealed completely by the valve head of the valve unit. When the measuring state is switched to the applying state by rotating the operating unit and allowing the valve unit and the stopper unit to relative ascending/descending displace, the sealing top surface of the stopper unit leaves the lower surface of the valve head of the valve unit at a halfway in the switching operation. The bottle unit inside is opened to the outside through the vertical hole of the valve head. Thus, before the pouring out mouth is opened by operating the valve unit, it becomes possible to eliminate previously the pressure difference between the bottle unit inside and outside. This arrangement prevents occurrence of troublesome blow out of the liquid due to wrong high pressure in the bottle unit.

The invention according to claim 10 comprises the following feature in addition to the invention according to one of claims 1 to 9. The lower surface of the valve seat abuts against the sealing top surface of the stopper unit at the descending limit of the switching unit. An abutting step, against which a part of the switching unit abuts to set a descending limit for the switching unit, is provided at a terminal end of a part of said attaching unit of an ascending/descending displacement coupling function portion due to relative rotation of the attaching unit and the switching unit.

In the invention according to claim 10, the descending limit of the switching unit by rotational operation of the operating unit is set by the abutting step of the attaching unit. There is no occasion in which the valve seat is caught up at a pressure more than necessary between the lower peripheral part of the pouring out mouth of the operating unit and the sealing top surface of the stopper unit. Therefore, occurrence of damage such as deformation to the valve seat is prevented.

The invention according to claim 11 comprises the following feature in addition to the invention according to one of claims 1 to 10. An ascending/descending coupling by rotational movement of the switching unit relative to the attaching unit comprises threaded coupling between a helical ridge provided on an outer circumference surface of the attaching tube of said attaching unit and a helical ridge provided on an inner circumference surface of the main tube of said switching unit.

In the invention according to claim 11, since rotation between the attaching unit and the switching unit and coupling for the ascending or descending displacement is achieved by threaded coupling, the coupling structure can be easily formed, and assembling operation can be simply achieved.

The invention according to claim 12 comprises the following feature in addition to the invention according to one of claims 1 to 10. An ascending/descending coupling by rotational movement of the switching unit relative to the attaching unit comprises engagement coupling between guide grooves with sloped attitude formed on an outer circumference surface of the attaching tube of said attaching unit and guide projection pieces provided on an inner circumference surface of the main tube of said switching unit.

In the invention according to claim 12, since rotation between the attaching unit and the switching unit and coupling for the ascending or descending displacement is achieved by the engagement of the guide projections with the guide grooves, it becomes possible to set freely an ascending/descending stroke with respect to a relative rotational movement in a state in which a stable posture keeping ability at the ascending limit position and the descending limit position can be exhibited. With this, it is possible to make the handling of the applying stopper be favorable.

The invention according to claim 13 comprises the following feature in addition to the invention according to one of claims 1 to 12. A diameter of a part of discharge side of the pouring out mouth of the operating unit is step-likely enlarged to be formed to an enlarged diameter opening portion.

In the invention according to claim 13, the liquid can be smoothly and effectively applied to the surface, but the liquid is prevented from flowing out excessively, because an opening area of the pouring out mouth facing the applied surface can be widened while suitably maintaining a cross-sectional area of the flow passage of the pouring out mouth for pouring out the contained liquid.

The invention according to claim 14 comprises the following feature in addition to the invention according to one of claims 1 to 13. Three or more window holes are provided on a tube wall of the erect tube which is provided to form the open upper end of the central part of the attaching unit, and the window holes are provided at regular intervals in a circumferential direction and extend from an upper end to a lower end of said tube wall.

In the invention according to claim 14, a pushing force acting on the stopper unit at the measuring state is supported and distributed at three or more points equally in order to prevent the erect tube from being deformed and deviated from axial alignment by the pushing force with the lapse of time. Further, The arrangement of window holes along the circumference of the erect tube makes the liquid and air flow through the window holes smooth and steady as the vessel is tilted, with no regard to the tilting direction.

The invention according to claim 15 comprises the following feature in addition to the invention according to one of claims 1 to 14. A pair of engaging vertical grooves, which are opened upwardly, are provided symmetrically with respect to a central axis on the outer circumference surface of the threaded engagement main tube of the switching unit. A pair of vertical engaging ridges are provided symmetrically with respect to the central axis on the inner circumference surface of the outer tube, which is an attaching portion of the operating unit to the switching unit. The vertical engaging ridges engages with the pair of vertical engaging grooves to make rotation of the operating unit against the switching unit impossible. A lower end of one of the vertical engaging ridges is positioned lower than that of the other of the vertical engaging ridges.

In the invention according to claim 15, by differing the height positions of the pair of vertical engaging ridges of the operating unit, it is possible to specifically determine the set direction of the operating unit by means of an automatic assembling machine. It is automatically achieved to align the display effected on the surface of the operating unit with the display effected on the surface of the bottle unit by regulating the direction of attaching posture of the operating unit at constant with respect to the switching unit which has been attached to the attaching unit with a constant direction.

The invention according to claim 16 comprises:

a bottle unit having a mouth tube on top thereof;

an applying stopper, which comprises

- an attaching unit, which is tightly and immovably attached to the mouth tube of the bottle unit and is provided with a stopper unit having a sealing outer flange in an open upper end of a central portion;
- a switching unit, which is fitted tightly onto said attaching unit so as to move upwardly and downwardly with a certain stroke in relative rotational movement and is provided with an inner tube stood at a central portion so that said sealing outer flange tightly fits into a top end opening at ascending limit for said switching unit;
- an operating unit of a cylindrical shape having a top plate, which is fitted tightly and immovably onto said switching unit, and is provided with a pouring out mouth at an upper end, said operating unit defining a measuring chamber of a certain volume together with said switching unit; and
- a valve unit, which is provided with a valve head fitted into said pouring out mouth in such a manner that an upper end portion thereof can protrude from said mouth and a valve seat provided around a lower end of said valve head and coming into close contact with a lower end opening portion of said pouring out mouth, said valve unit giving an upward elastic force to an integrated member of said valve seat and said valve head; and
- a cap unit, which covers said applying stopper and is removably fitted onto an upper end of a barrel portion of said bottle unit;

wherein a skirt tube is connected to a lower end of the attaching tube in a suspended manner, which is a main part of said attaching unit, through a connecting outer flange, said skirt tube being positioned right under the operating unit in an exposed manner; wherein parts of said skirt tube are structured to be displaceable sections which can be elastic deformed in radial direction by cutouts extending from said skirt tube to said connecting outer flange; and wherein a hook, with which a stopper projected at a lower end of an inner circumference surface of said operating unit engages from the ascending rotation direction, is provided on an upper surface of each displaceable section.

In the invention according to claim 16, since, in the measuring state, the stoppers of the operating unit engage with the hooks of the attaching unit attached immovably to the bottle unit from ascending rotation direction, that is, rotation direction toward the applying state, it is not possible to rotationally operate the operating unit to the applying state with this state. However, it becomes possible to rotationally operate the operating unit to the applying state by pressing and displacing the displaceable sections of the attaching unit.

Therefore, the applying stopper cannot be opened unless one knows the procedure of rotating the operating unit toward the applying state while pushing and displacing the displaceable sections of the attaching unit. With this, wrong opening is prevented and high safety can be obtained.

The invention according to claim 17 comprises:

a bottle unit having a mouth tube on top thereof;

an applying stopper, which comprises an attaching unit, which is tightly and immovably attached to the mouth tube of the bottle unit and is provided with a stopper unit having a sealing outer flange in an open upper end of a central portion;

a switching unit, which is fitted tightly onto said attaching unit so as to move upwardly and downwardly with a certain stroke in relative rotational movement and is provided with an inner tube stood at a central portion so that said sealing outer flange tightly fits into a top end opening at ascending limit for said switching unit;

an operating unit of a cylindrical shape having a top plate, which is fitted tightly and immovably onto said switching unit, and is provided with a pouring out mouth at an upper end, said operating unit defining a measuring chamber of a certain volume together with said switching unit; and a valve unit, which is provided with a valve head fitted into said pouring out mouth in such a manner that an upper end portion thereof can protrude from said mouth and a valve seat provided around a lower end of said valve head and coming into close contact with a lower end opening portion of said pouring out mouth, said valve unit giving an upward elastic force to an integrated member of said valve seat and said valve head; and a cap unit, which covers said applying stopper and is removably fitted onto an upper end of a barrel portion of said bottle unit;

wherein a cap-fitting/removing unit is unremovably fitted onto an upper portion of the bottle unit in, said cap-fitting/removing unit having hooking ridges engaging with a lower end of an inner circumference surface of the cap unit fitted onto said bottle unit so as to make it impossible to remove said cap unit from the bottle unit, said hooking ridges being provided on upper end portions of tongue-like wall sections exposed for the most part right under the cap unit fitted on the bottle unit, and wherein said tongue-like wall sections are structured so that upper end portions thereof can be elastically displaced in a direction in which the upper end portions come close to the bottle unit by pressing operation.

In the invention according to claim 17, because the hooking rides of the cap-fitting/removing unit unremovably attached and fixed on the bottle unit are in engagement with the lower end of the inner circumference surface of the cap unit, it is impossible to separate the cap unit from the bottle unit with this state. However, by pushing and elastically displacing the tongue-like wall sections of the cap-fitting/removing unit to release the engagement of the hooking ridges to the lower end of the inner circumference surface of the cap unit, separation of the cap unit from the bottle unit becomes possible.

Therefore, the cap unit cannot be removed from the bottle unit to put the applying stopper in the open applicable state, unless one knows the procedure of removing the cap unit from the bottle unit while flexibly displacing the tongue-like wall sections of the cap-fitting/removing unit. With this, wrong opening is prevented and high safety can be obtained.

The invention according to claim 18 comprises the following feature in addition to the invention according to claim 1. Each of components of the applying stopper and the cap unit is made of synthetic resins.

In the invention according to claim 18, since, on structure of the vessel for pouring out and applying a constant volume of liquid, each of the structural components is required to have high demand functions such as smoothness of action, flexible deformability in response to the interference under the sealing condition, and needs of elastic force of applying structure, synthetic resins are the most favorable as the molding materials for components. This is because synthetic resins have many alternatives to such requirements, are highly moldable, and can be manufactured at low costs.

BEST MODE FOR CARRYING OUT THE INVENTION

The embodiments of the invention will be described with reference to the drawings.

Figure 1:
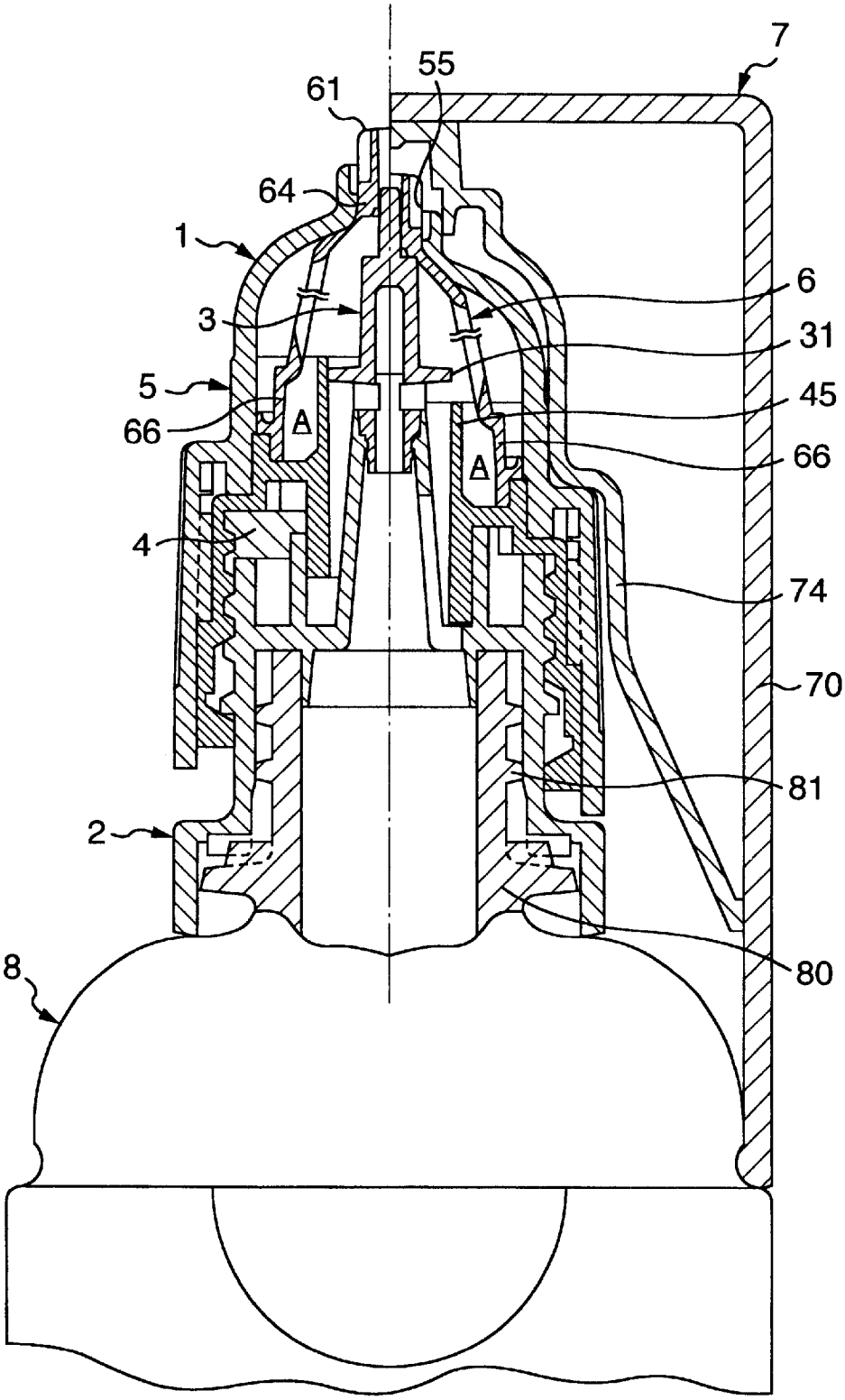
FIG. 1 is a vertical cross-sectional front view of the vessel, showing a first embodiment of the invention, wherein the right half of the drawing indicates measuring state unable to be opened; and the left half indicates applying state able to be opened.

FIG. 1 shows an entire vertical cross-sectional view, wherein an applying stopper 1 is attached to a mouth tube 80 of a bottle unit 8. In FIG. 1, the right half indicates an unused state and a measuring state of a vessel for pouring out and applying a constant amount of liquid and the left half indicates a usable state and an applying state.

Figure 3:
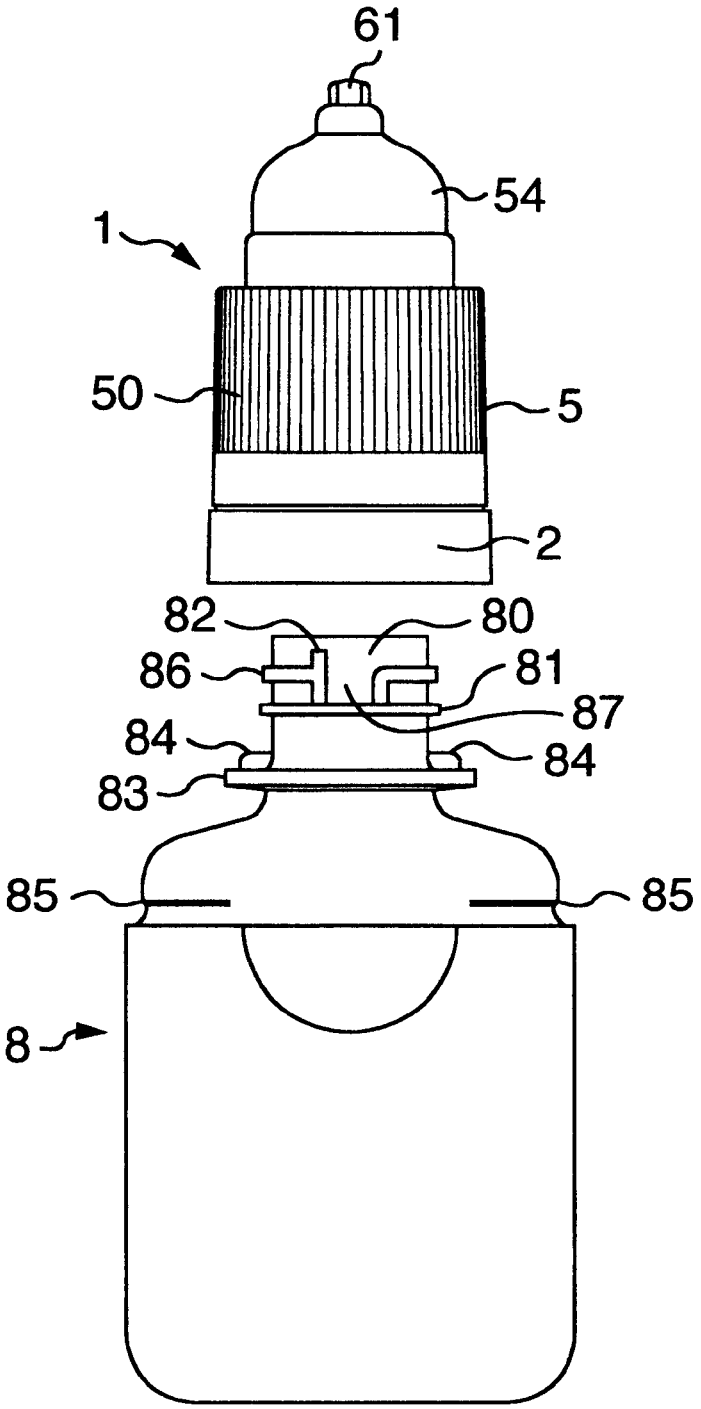
FIG. 3 is a front view showing separately a bottle unit and a pouring out and applying stopper in the embodiment shown in FIG. 1.

The mouth tube 80 (See FIG. 3) of the bottle unit 8, to which the applying stopper 1 is attached, is provided with a circumferential stop ridge 81 provided on a central part of an outer circumference surface of the mouth tube, a vertical stop ridge 82 disposed on an upper area of the outer circumference surface, a circumferential ridge 86 disposed in parallel with the circumferential stop ridge 81 and connected to the vertical stop ridge 82 at one end and forming at the other end a vacant zone 87 together with the vertical stop ridge 82, an outer flange 83 provided at a lower portion of the outer circumference surface, and a pair of projections 84 formed at diametrical opposite positions on an upper surface of the outer flange 83. A pair of engaging recesses 85 are formed on both sides of an upper portion of a barrel, section of which is substantially elliptical form.

An attaching unit 2 is provided with a skirt tube of which diameter is enlarged at a lower end. A helical ridge 23 (in the case of an embodiment shown in FIGS. 4, 5, and 6) or a guide groove 23*b* (in the case of an embodiment shown in FIGS. 7 and 8) is provided on an outer circumference surface. An attaching tube 20, which is fitted onto the mouth tube 80 of the bottle unit 8, is provided with an inner flange 24 on an upper area of an inner circumference surface. A sealing tube 26 having a straight cylindrical shape is stood on an upper surface of the inner flange 24. An erect tube 27, which is relatively tall and tapered toward upward, is stood from an inner periphery of the inner flange 24, and is provided with window openings 28.

The window openings 28 are provided at three positions equally spaced from each other in an circumferential direction so as to stabilize the erect tube 27 structurally, to prevent the erect tube 27 from being deformed and deviated from an axially aligned position due to aging, and to ensure that air and liquid smoothly flow through the window openings 28 without being influenced by tilted direction of the bottle unit 8.

On the inner circumference surface of the attaching tube 20 below the inner flange 24, disposed is a vertical control ridge 22, which abuts against the vertical stop ridge 82 of the bottle unit 8 in the circumferential direction and against the circumferential ridge 86 from upside. The vertical control ridge 22 of the attaching unit 2 tightly fits into the vacant zone 87 of the bottle unit 8. Below this vertical control ridge 22, disposed is a stop ridge 21, which goes over the circumferential stop ridge 81 of the bottle unit 8 for the undercut attachment. A pair of recessions 20*a* is provided on a lower end face of the attaching tube 20 at positions diametrically opposite to each other. These recessions 20*a* engage with the projections 84 of the bottle unit 8 to immovably retain attachment attitude of the attaching unit 2 with respect to the bottle unit 8 to a position aligned with the bottle unit.

Figure 4:
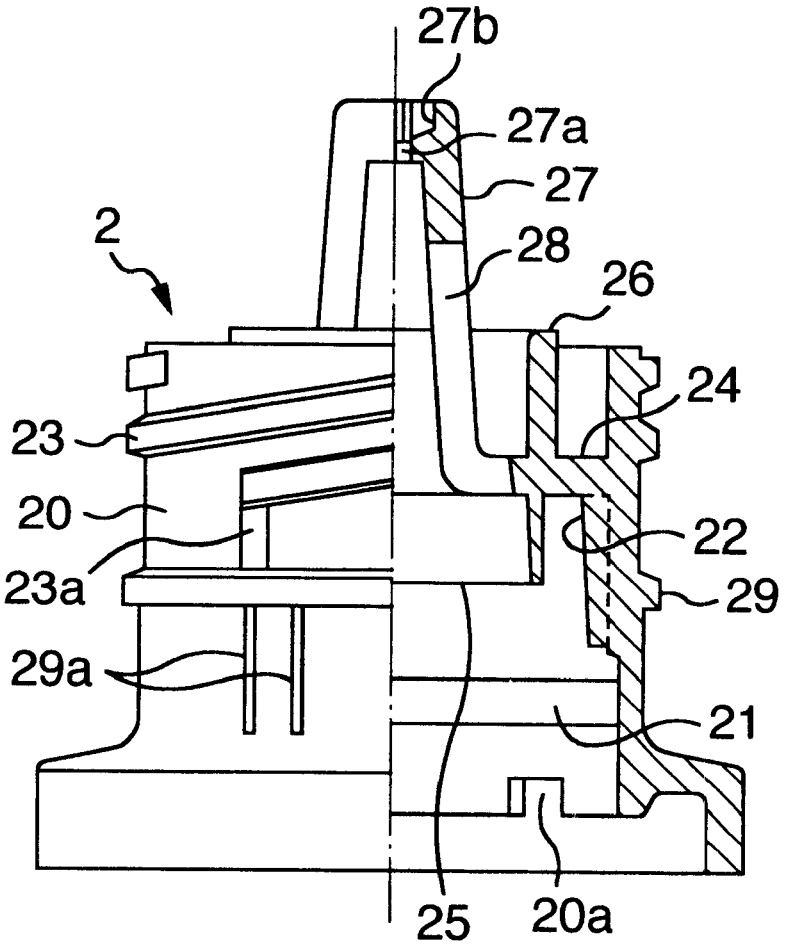
FIG. 4 is a front view of an attaching unit in the embodiment shown in FIG. 1, wherein the right half is a vertical cross-sectional view.
Figure 5:
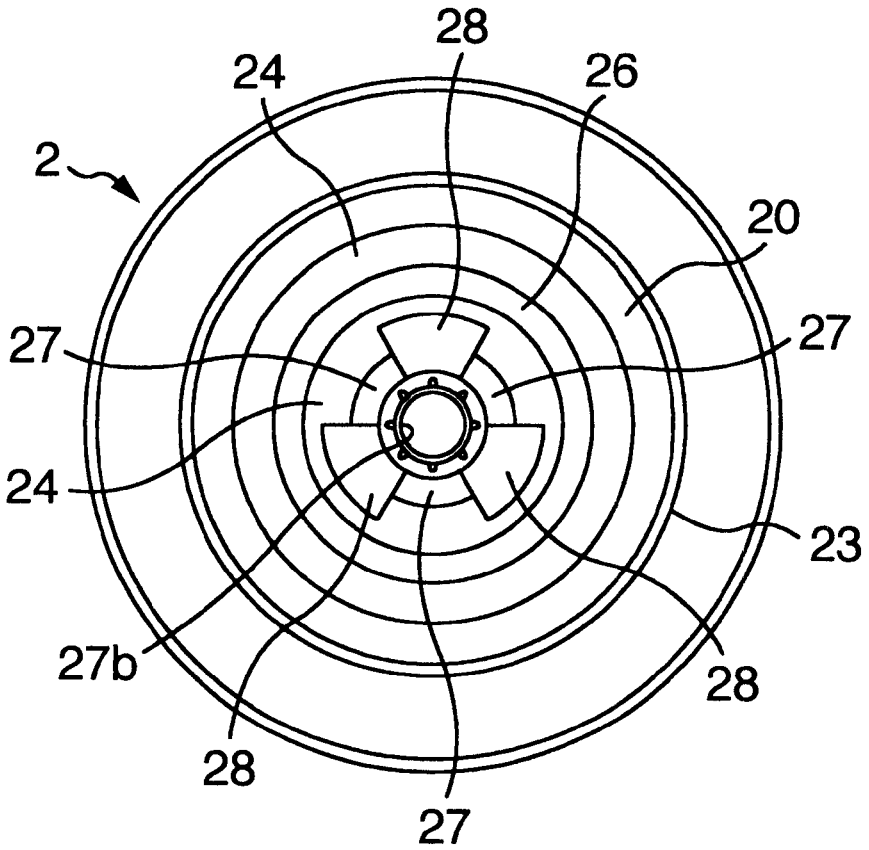
FIG. 5 is an entire plan view of the attaching unit shown in FIG. 4.
Figure 6:
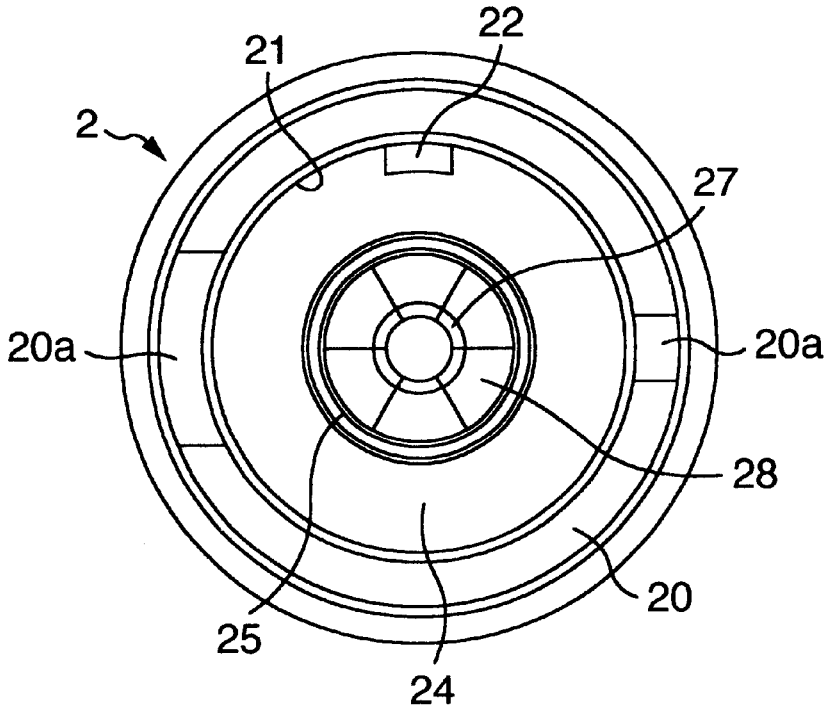
FIG. 6 is an entire bottom view of the attaching unit shown in FIG. 4.

In the case of the embodiment shown in FIGS. 4 and 6, a stop ridge 29 is disposed in a circumferential direction on the outer circumference surface of the attaching tube 20 below the helical ridge 23. A vertical rib is disposed between the stop ridge 29 and a terminal of the helical ridge 23. The vertical rib constitutes a dead end step 23*a*, against which a terminal surface of a helical ridge 40*a* disposed on an inner wall of a switching unit 4 at the descending limit of the switching unit 4. Two pairs of low vertical ridges 29*a* are disposed at positions diametrically opposite to each other under the stop ridge 29. In addition, a fitting tube 25 is disposed under the inner flange 24 and it tightly fits into the opening of the mouth tube 80.

Figure 7:
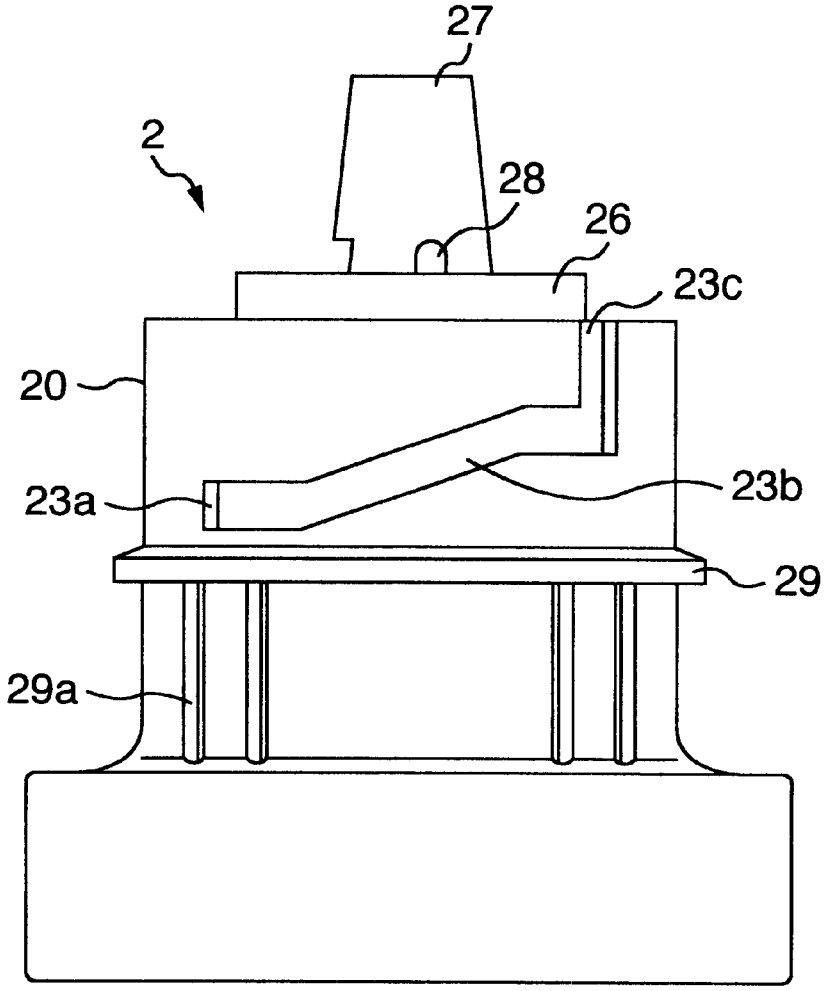
FIG. 7 is an entire front view of another embodiment of the attaching unit.
Figure 8:
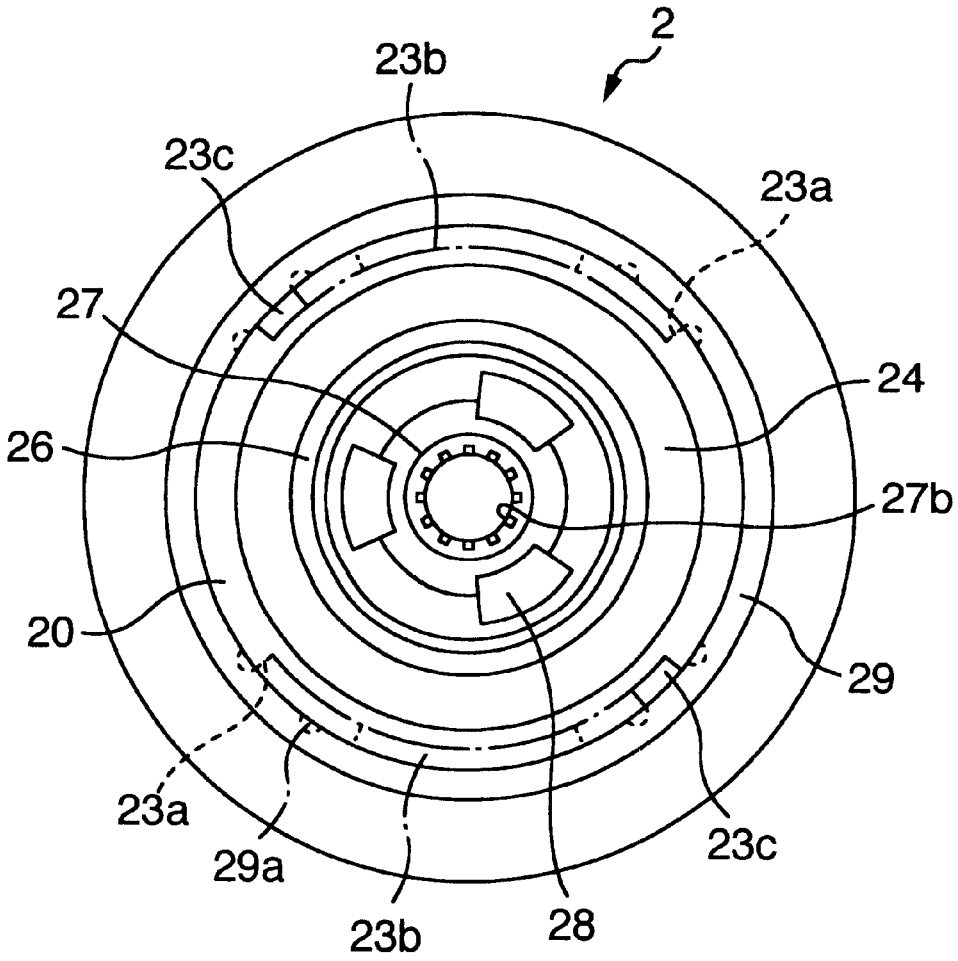
FIG. 8 is an entire plan view of the attaching unit shown in FIG. 7.

In the case of the embodiment shown in FIGS. 7 and 8, a pair of guide grooves 23*b* are disposed at positions diametrically opposite to each other, with both of upper and lower ends being flat and having no slope. A lower terminal end of the guide groove 23*b* defines a dead end step 23*a* against which projected guide piece 40*b* of the switching unit 4 abuts. At an upper terminal end, the guide groove 23*b* is provided with a vertical inserting groove 23*c* with which a projected guide piece 40*b* of the switching unit 4 is engaged and attached.

In the case of the guide grooves 23*b* in the embodiment shown in FIGS. 7 and 8, even if the ascending/descending displacement of the switching unit 4 with respect to relative rotational movement is set larger by increasing angle of slope, the position of vertical displacement of the switching unit 4 can be retained in stable against external force, as long as the guide grooves 23*b* have flat terminal ends.

The vertical control ridge 22 of the attaching unit 2 is inserted into the vacant zone 87 and is engaged therewith to align the attaching unit 2 directionally with respect to the bottle unit 8. Thereafter, the vertical control ridge 22 is forcibly pushed against the bottle unit 8 to make the stop ridge 21 engaged with the circumferential stop ridge 81 for the undercut attachment. Additionally, the recessions 20*a* are engaged with the projections 84 of the bottle unit 8 so that the attaching unit 2 is firmly attached to the mouth tube 80 of the bottle unit 8. Tight attachment is obtained by inserting the fitting tube 25 tightly into the opening of a mouth tube 80 of the bottle unit.

Figure 2:
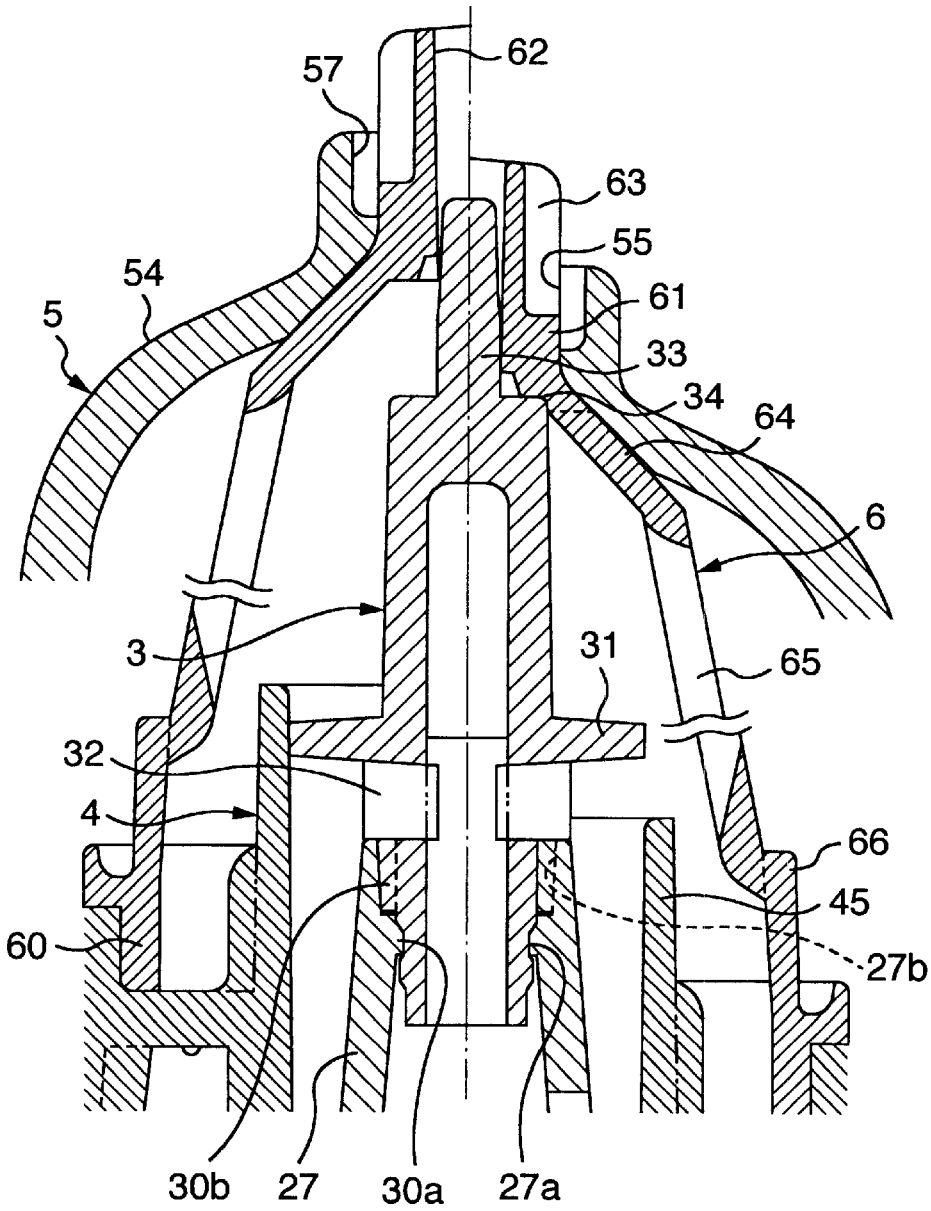
FIG. 2 is an enlarged explanatory view of a combination of the stopper unit and the valve unit in the embodiment shown in FIG. 1.
Figure 9:
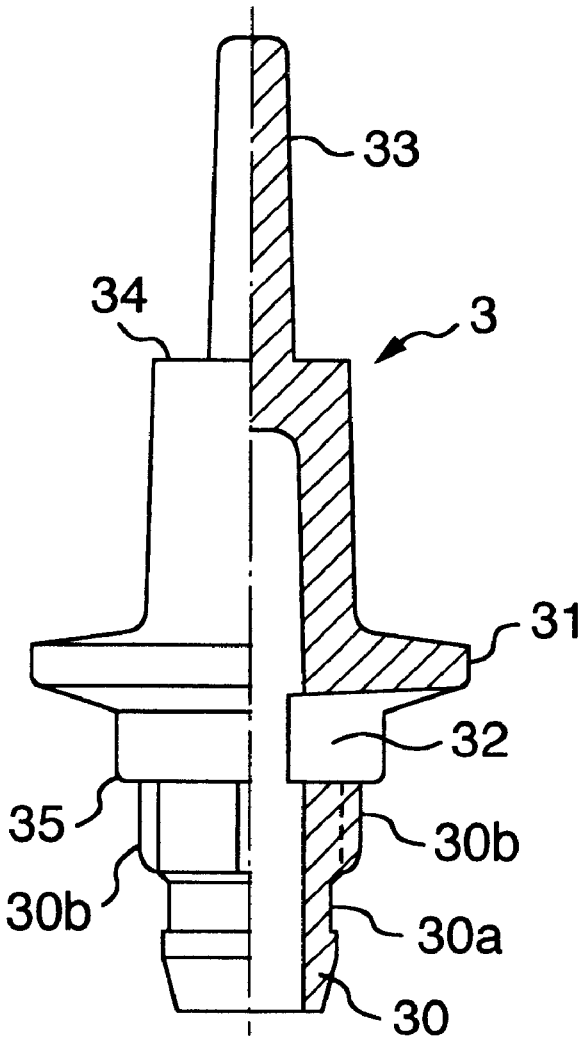
FIG. 9 is a front view of a stopper unit in the embodiment shown in FIG. 1, wherein the right half is a vertical cross-sectional view.

A stopper unit 3 (See FIGS. 2 and 9) comprises a fitting portion 30 of a thin cylindrical shape provided with ceiling. An sealing outer flange 31, which is somewhat thick, is disposed in a circumferential direction at a middle height position of an outer circumference surface of the fitting portion 30. A projected stopper piece 33 of an upright thin rod shape is erected from the center of a flat sealing top surface 34. On the cylindrical wall just under the sealing outer flange 31 of the fitting portion 30 disposed is a communication holes 32, which help liquid flow from inside the bottle unit 8 to a measuring chamber A. A shoulder portion 35 is disposed on the outer circumference surface of the fitting portion 30 just under the communication holes 32, and is used to set the limit of insertion and attachment to the erect tube 27 of the attaching unit 2. The stopper unit 3 is securely attached to the attaching unit 2 by fitting the stop ridge 27*a* of the erect tube 27 into a circumferential stop groove 30*a* which is disposed in a circumferential direction on the fitting portion 30 below the shoulder portion 35, and by fitting a plurality of vertical stop ridges 30*b* into vertical stop grooves 27*b* of the erect tube 27.

Figure 10:
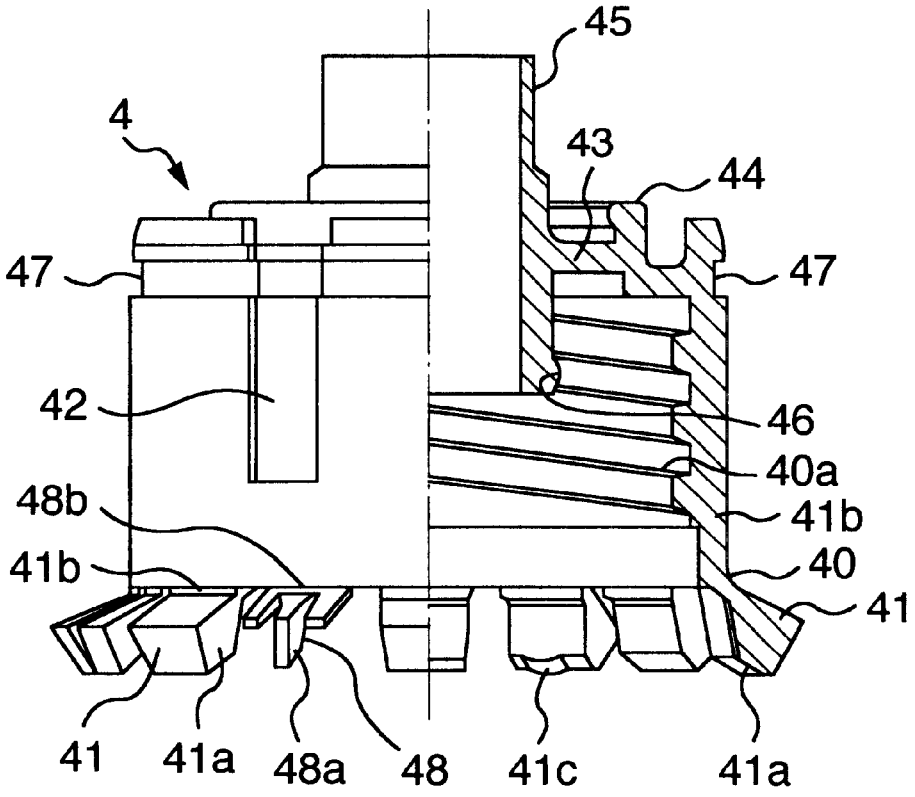
FIG. 10 is a front view of a switching unit in the embodiment shown in FIG. 1, wherein the right half is a vertical cross-sectional view.
Figure 11:
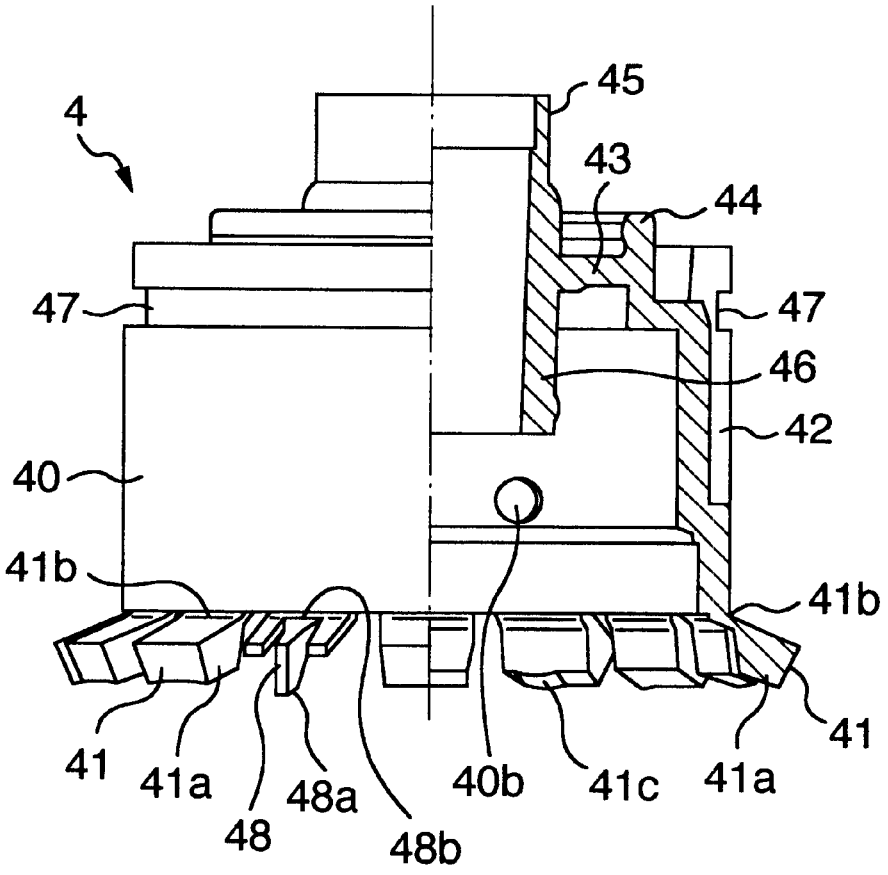
FIG. 11 is a front view of another embodiment of the switching unit, wherein the right half is a vertical cross-sectional view.
Figure 12:
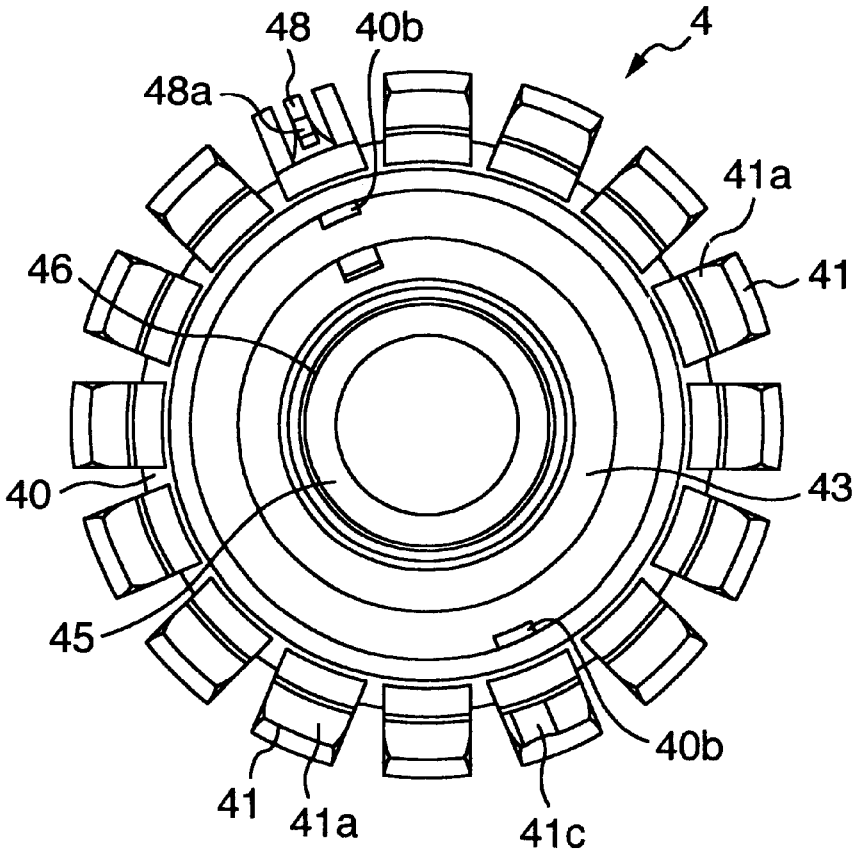
FIG. 12 is an entire bottom view of the embodiment shown in FIG. 11.

The switching unit 4 comprises a main tube 40 of a cylindrical shape. A helical ridge 40*a,* which engages with the helical ridge 23 (see FIG. 10), or projected guide pieces 40*b,* which fit into the guide grooves 23*b* (see FIGS. 11 and 12), is disposed on an inner circumference surface of the main tube 40. A top plate ring 43 of an inner flange shape is connected to an upper end of the inner circumferential surface of the main tube 40. An inner tube 45, which is tightly and slidably inserted into the sealing tube 26 of the attaching unit 2 and which the sealing outer flange 31 of the stopper unit 3 is tightly fitted into an upper opening of the inner tube 45, is connected to an inner circumferential periphery of the top plate ring 43 at a central position of the main tube 40.

A plurality of escape-preventing pieces 41, which are provided with abutting convex portions 41*a* on the inside, and a thin-plate sounding piece 48 having a surmountable convex portion 48*a* on the inside are integrally connected to the lower periphery of the main tube 40 through thin portions 41*b* and the thin portion 48*b* in such a manner that they can be bent and in an expanded state. The surmountable convex portion 48*a* is projected larger than the abutting convex portions 41*a*. A low clicking projection 41*c* is provided on a protruding end face of the abutting convex portion 41*a* of an escape-preventing piece 41, which is located at a position diametrically opposite to the sounding piece 48.

A sealing circumferential ridge 46 is provided on the lower periphery of the outer circumference surface of the inner tube 45 for the purpose of securing and strengthening the tight contact of the inner tube 45 with the sealing tube 26 of the attaching unit 2. A pair of vertical engaging grooves 42 and a circumferential engaging groove 47 are provided in the upper half area of the outer circumference surface of the main tube 40. An attaching cylindrical portion 44 of a short cylindrical shape having a circumferential ridge on its inner circumference surface is provided at a middle position on the top plate ring 43.

Thus, the main tube 40 is threadedly fitted onto the attaching tube 20 so that the main tube 40 is up and down displaced with a certain stroke by relative rotation therebetween. The switching unit 4 is undetachably attached to the attaching unit 2 because the abutting convex portions 41*a* abut against the stop ridge 29 from underside as described later. The switching unit 4 is tightly attached to the attaching unit 2 by inserting the inner tube 45 into the sealing tube 26. At the ascending limit, i.e., in the liquid-applying state, the inner tube 45 tightly fits onto the sealing outer flange 31 of the stopper unit 3, thereby a side of the bottle unit 8 is sealed.

Figure 13:
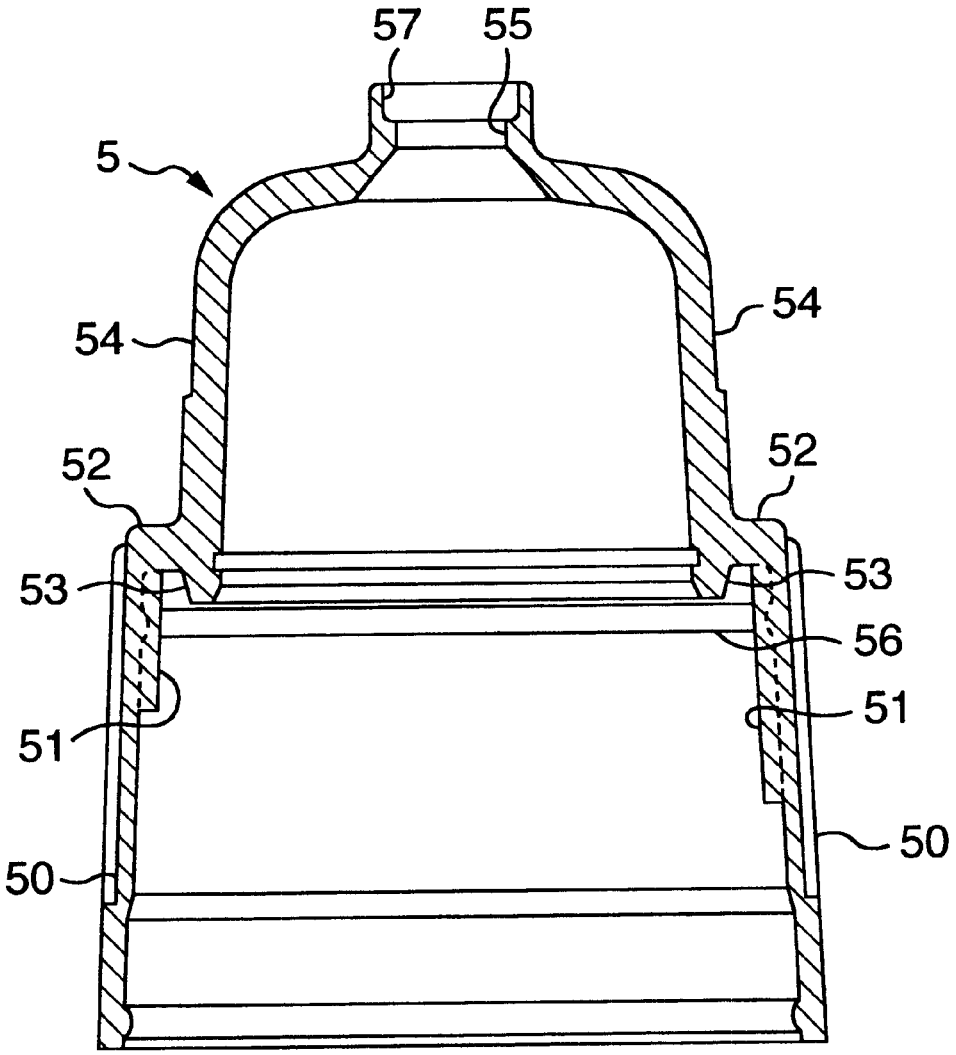
FIG. 13 is an entire vertical cross-sectional front view of an operating unit in the embodiment shown in FIG. 1.

The operating unit 5 (see FIG. 13) comprises a cylindrical outer tube 50, which fits onto the main tube 40 of the switching unit 4 without clearance, and an upper tube 54 having a dome-like top wall, which is connected to an inner flange of narrow width provided on an upper portion of the outer tube 50. The upper tube 54 forms a measuring chamber A having a constant volume together with the top plate ring 43 and the inner tube 45 of the switching unit 4. A pouring out tube is stood on an upper end, central portion of the dome-like top wall. An inner diameter of an upper half portion of the pouring tube which serves as a pouring out mouth 55, is expanded to be an expanded opening 57.

Thus, an application side opening of the pouring out mouth 55 becomes a large opening area by the expanded opening 57. With this structure, an application capacity is improved without increasing an area of a pouring out passage. The expanded opening 57 forms a liquid pool, and therefore, the liquid application is continued smoothly and favorably without interruption.

An immovable attachment of the operating unit 5 to the switching unit 4 is achieved by providing, on an upper half of the inner circumference surface of the outer tube 50, a pair of long and short vertical ridges 51 which are engaged with the pair of vertical engaging grooves 42 of the switching unit 4; and a circumferential ridge 56 which is engaged with the circumferential engaging groove 47. A tight engagement of the operating unit 5 with the switching unit 4 is achieved by providing a tight-fit short tube 53 which is tightly fitted onto the attaching tube 44 at an inner circumference end of a lower surface of the inner flange 52.

The vertical ridges 51 are different in length, i.e., the height positions of lower ends of the vertical ridges 51 are different. This is because the operating unit 5 is set in the predetermined direction when it is assembled by an automatic assembling machine. This makes it possible to direct a mark previously given on an outer circumference surface of the operating unit 5 always in alignment with a mark previously given on an outer circumference surface of the attaching unit 2.

When the operating unit 5 is fitted onto the switching unit 4, the escape-preventing pieces 41 and the sounding piece 48 of the switching unit 4, which have been in the spread state, are pushed by a lower end surface of the outer tube 50 of the operating unit 5, and are bent inwardly at the thin portions 41*b* and 48*b* (see FIG. 1).

Due to the bending displacement of the escape-preventing pieces 41 and the sounding piece 48, the abutting convex portions 41*a* of the escape-preventing pieces 41 engage with the stop ridge 29 from down side in such a manner that they cannot go over the stop ridge 29, so that the ascending limit for the switching unit 4 with respect to the attaching unit 2 is set. As the operating unit 5 is rotationally operated, the surmountable convex 48*a* of the sounding piece 48 and the clicking projection 41*c* of the escape-preventing piece 41 respectively go over the vertical ridges 29*a* and make a clicking sound and give the feel of click, right before the ascending limit and the descending limit for the switching unit 4 in rotational displacement relative to the attaching unit 2.

Figure 14:
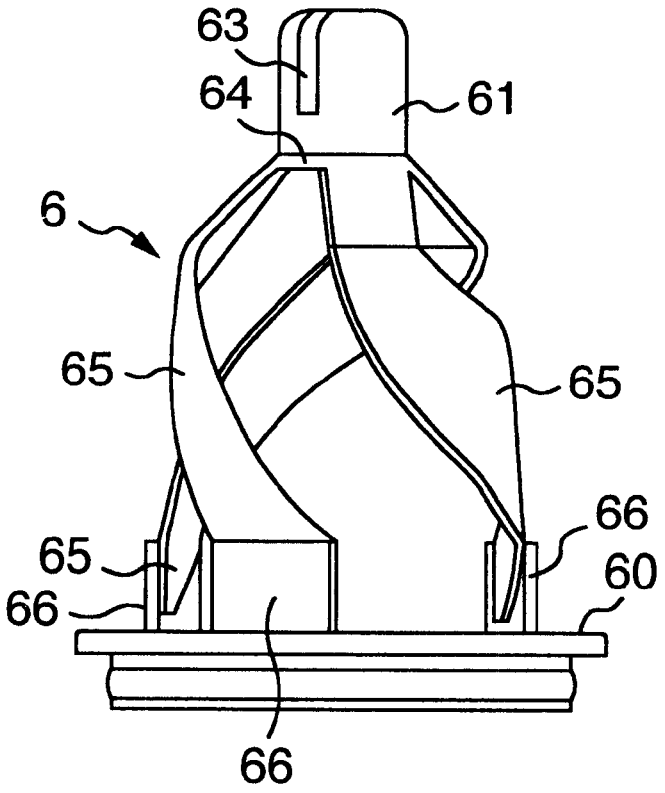
FIG. 14 is an entire front view of the valve unit in the embodiment shown FIG. 1.
Figure 15:
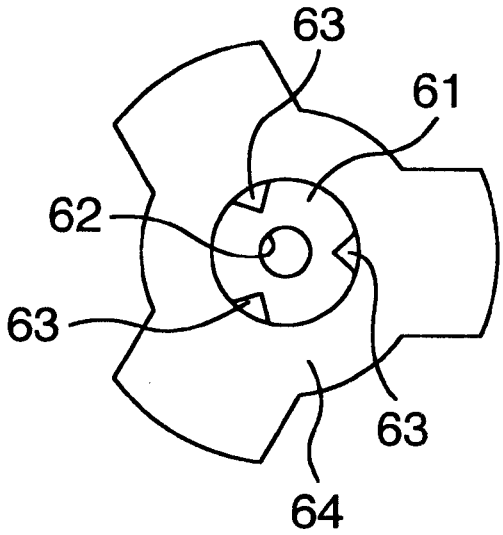
FIG. 15 is an entire plan view of the valve unit shown in FIG. 10.

A valve unit 6 (see FIGS. 14 and 15) comprises a short cylindrical valve head 61 with a height larger than the pouring out mouth 55 and a thickness to closely fit into the pouring out mouth 55. The valve head 61 is provided with several (3 in the drawings) of vertical grooves 63 on an upper half of an outer circumference surface and with a vertical through hole 62 at the center. The valve unit 6 also comprises a valve seat 64, which is disposed under the valve head 61, and has top tapered surface, with downward slope spreading toward the end thereof. Several (3 in the drawings) of helical elastic elements 65, giving an upward elastic force, are connected to the valve seat 64 at the upper ends.

The several elastic elements 65 are respectively fixed to upper inner surfaces of a plurality of fixing plates 66 of a rectangular shape at their lower ends. The fixing plates 66 are stood on an inner edge of an upper surface of an attaching ring 60 having an engagement ridge on an outer circumference surface. The valve unit 6 is attached to the switching unit 4 by fitting the attaching ring 60 into the attaching tube 44 of the switching unit 4 to effect the undercut coupling.

The fixing plates 66 of the valve unit 6 are formed to have a height substantially close to the height of the inner tube 45 so as to make a volume of the measuring chamber A occupied by the elastic elements 65 when they are deformed as small as possible.

Upper ends of the elastic elements 65 are connected to portions of the valve seat 64, which extend equiangularly from the periphery of the valve seat so that the portions connected with the upper ends of the elastic elements 65 does not affect the valve-closing action of the valve seat 64.

A bottom surface of the valve seat 64 is a flat surface with which the top sealing surface 34 of the stopper unit 3 can come into contact. The vertical through hole 62 of the valve head 61 has a diameter into which the projected stopper piece 33 of the stopper unit 3 can loosely fit (see FIG. 1).

Figure 16:
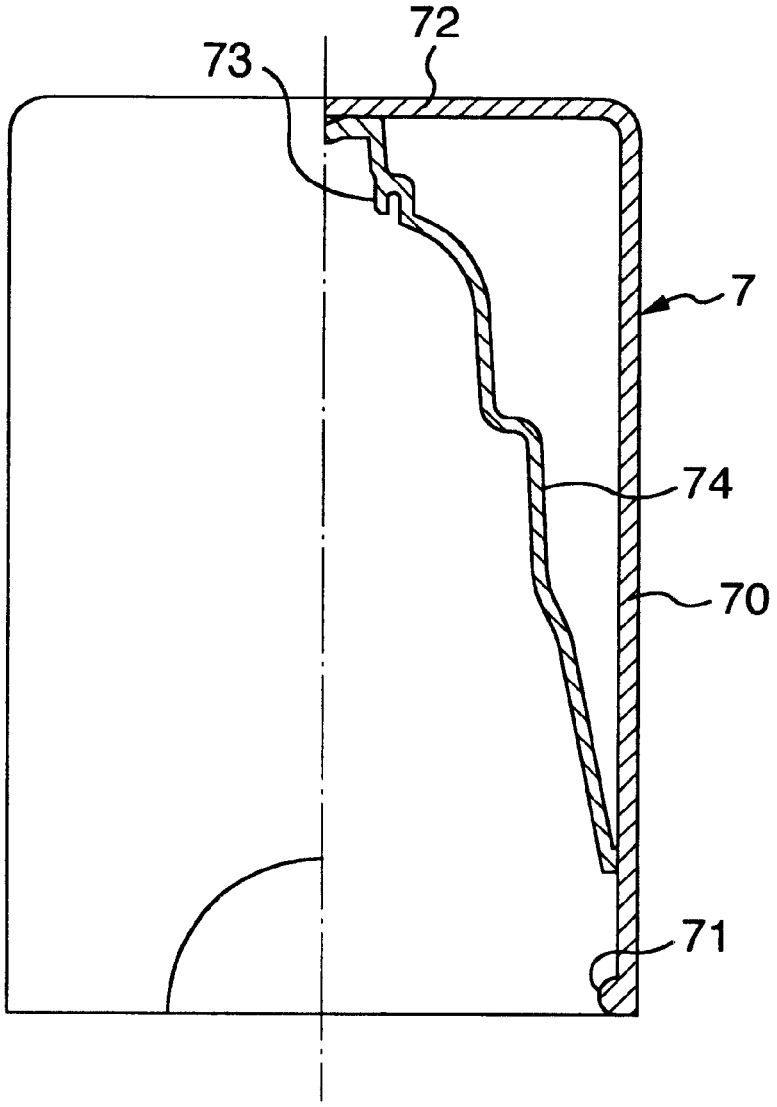
FIG. 16 is a front view of a cap unit in the embodiment shown in FIG. 1, wherein the right half is a vertical cross-sectional view.

A cap unit 7 (See FIGS. 1 and 16) is structured to be a duplicated structure comprising an external cap 70 and an internal cap 74. The external cap 70 has a shape of an elliptic tube provided with a top plate 72, and has a pair of engaging convex portions 71 at positions diametrically opposite to each other and on a lower end of an inner circumference surface. The internal cap 74 has a dome-like shape, which covers the operating unit 5, and is fixed to the top plate 72 of the external cap 70. The internal cap 74 is provided with a stopper tube 73 to seal the pouring out mouth 55.

The cap unit 7 is removably attached to the bottle unit 8 by engaging the engaging convex portions 71 with engaging concave portions 85 of the bottle unit 8. At that time, an inner surface of the dome-like inner cap 74 serves as a guide surface for an upper part of the pouring out and applying stopper 1, and thus the cap unit 7 can be fitted easily and smoothly.

Figure 17:
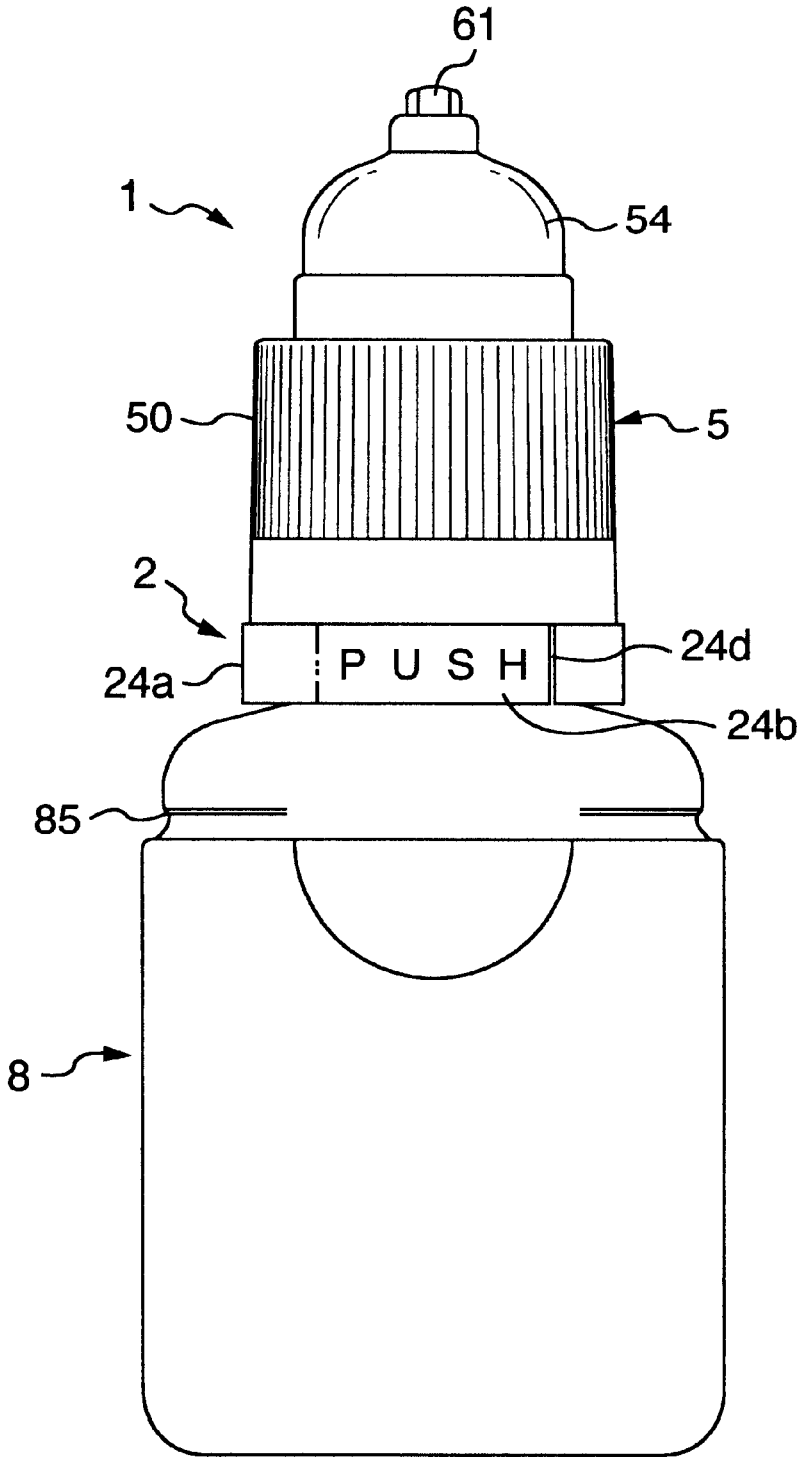
FIG. 17 is an entire front view showing a second embodiment of the invention, wherein the cap unit is removed.
Figure 18:
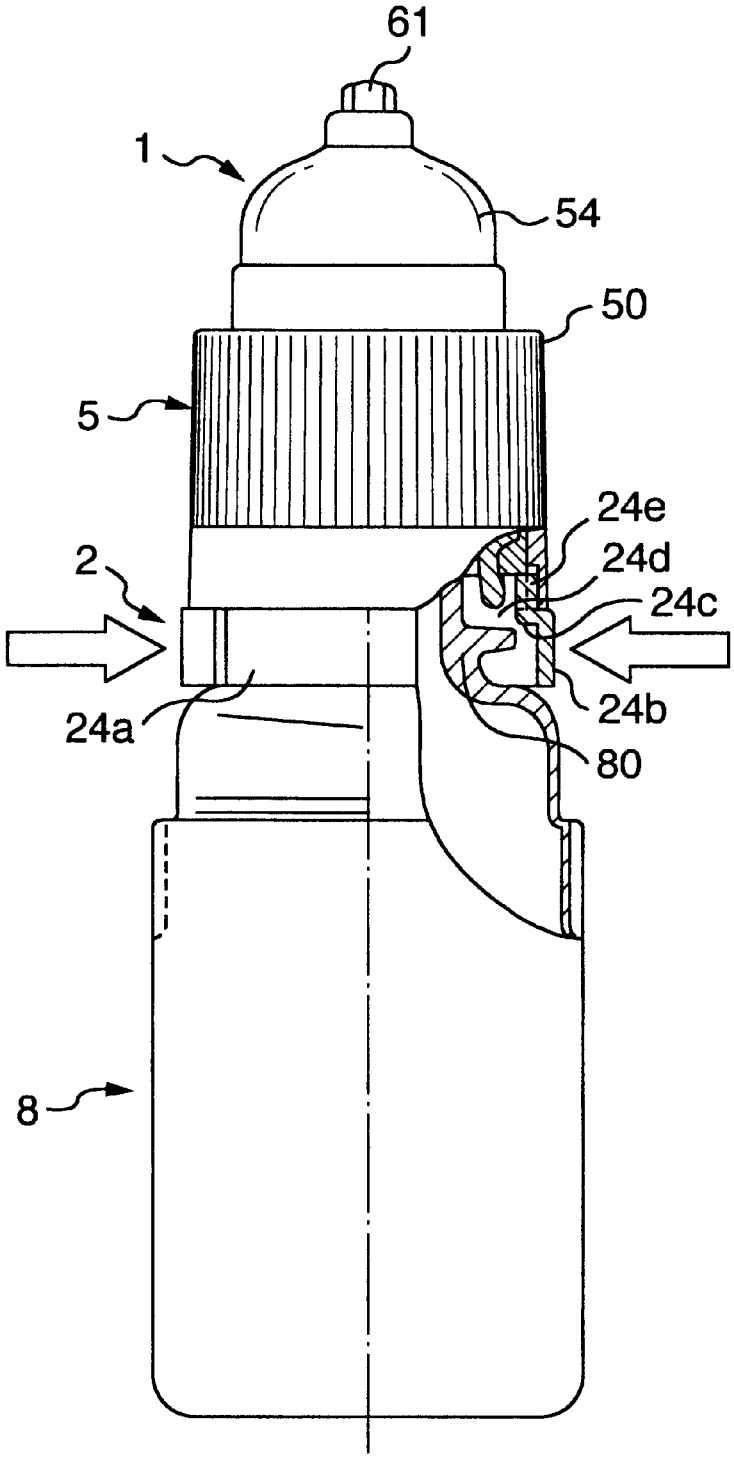
FIG. 18 is an entire side view of the embodiment shown in FIG. 17, wherein a main portion is shown in a vertical cross-sectional view.
Figure 19:
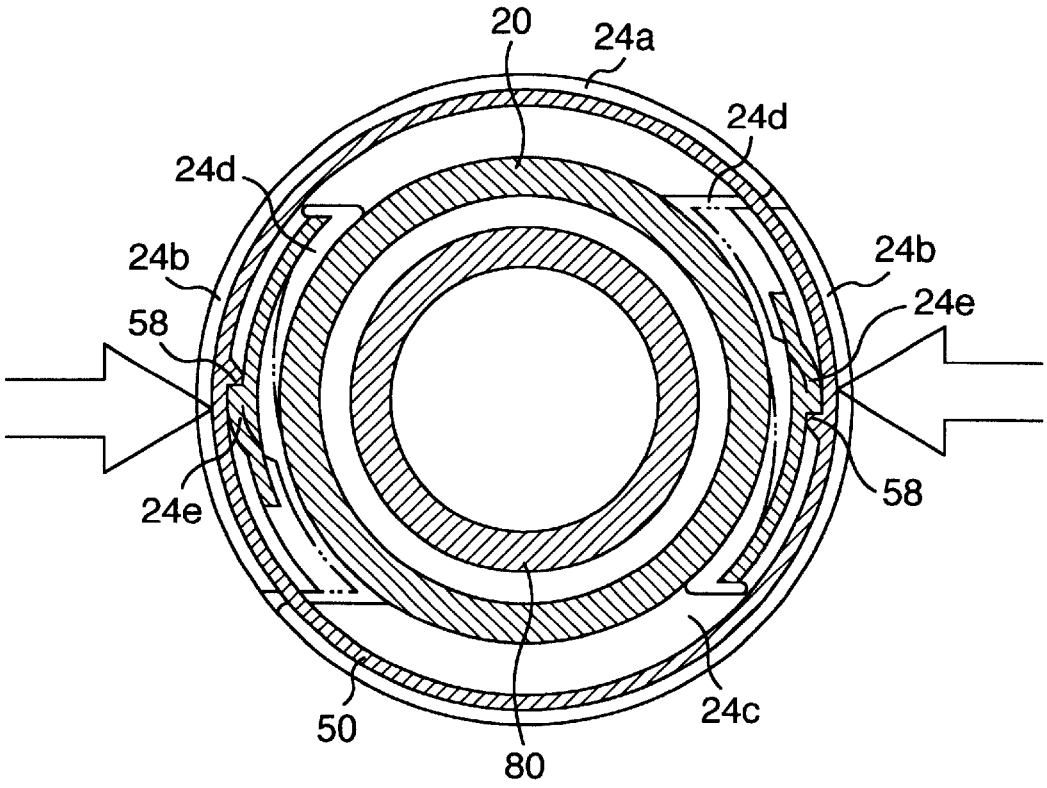
FIG. 19 is an enlarged lateral cross-sectional view of a main portion of the embodiment shown in FIG. 17.
Figure 20:
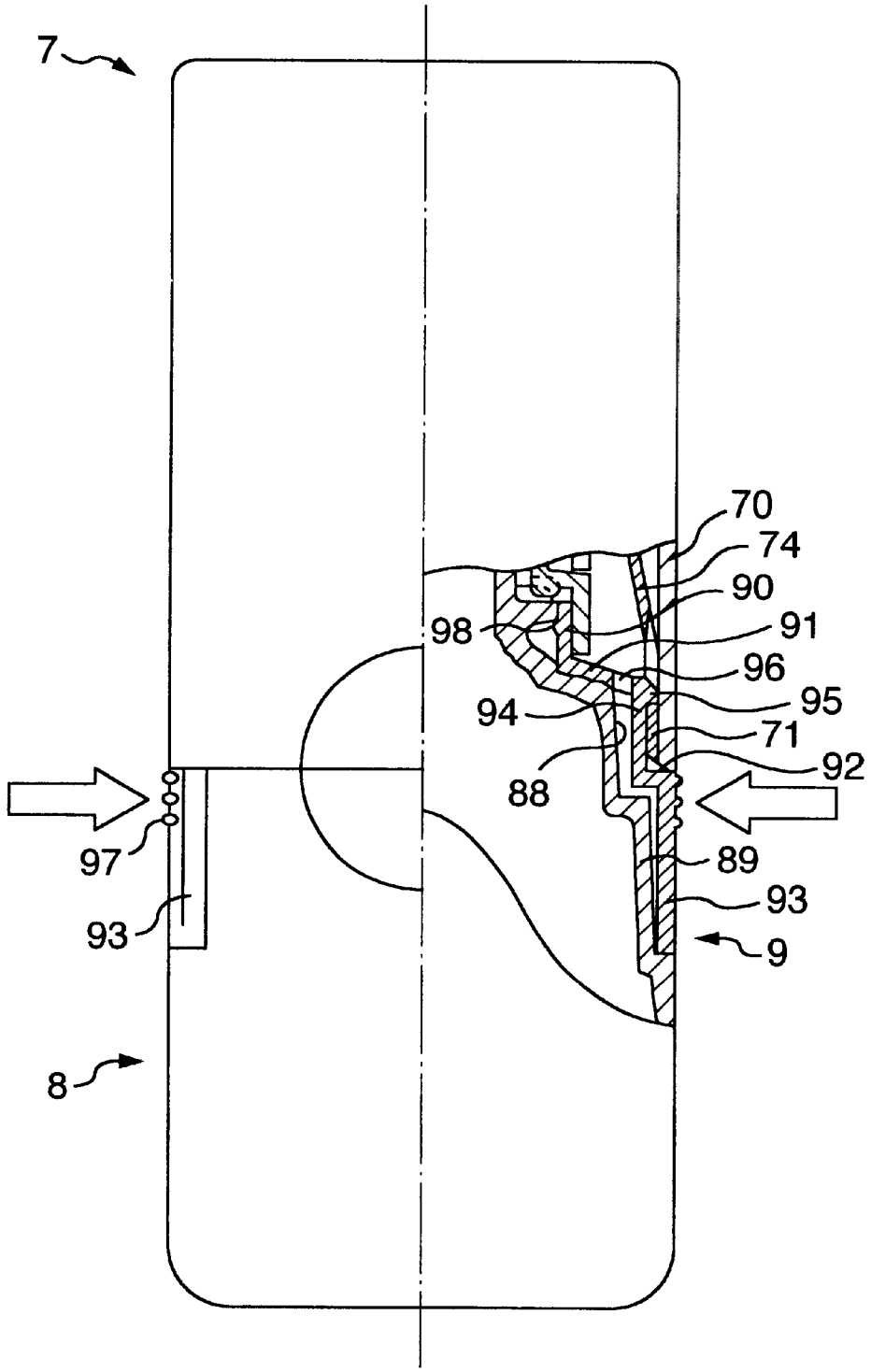
FIG. 20 is an entire front view showing a third embodiment of the invention, wherein a main portion is shown in a vertical cross-sectional view.
Figure 21:
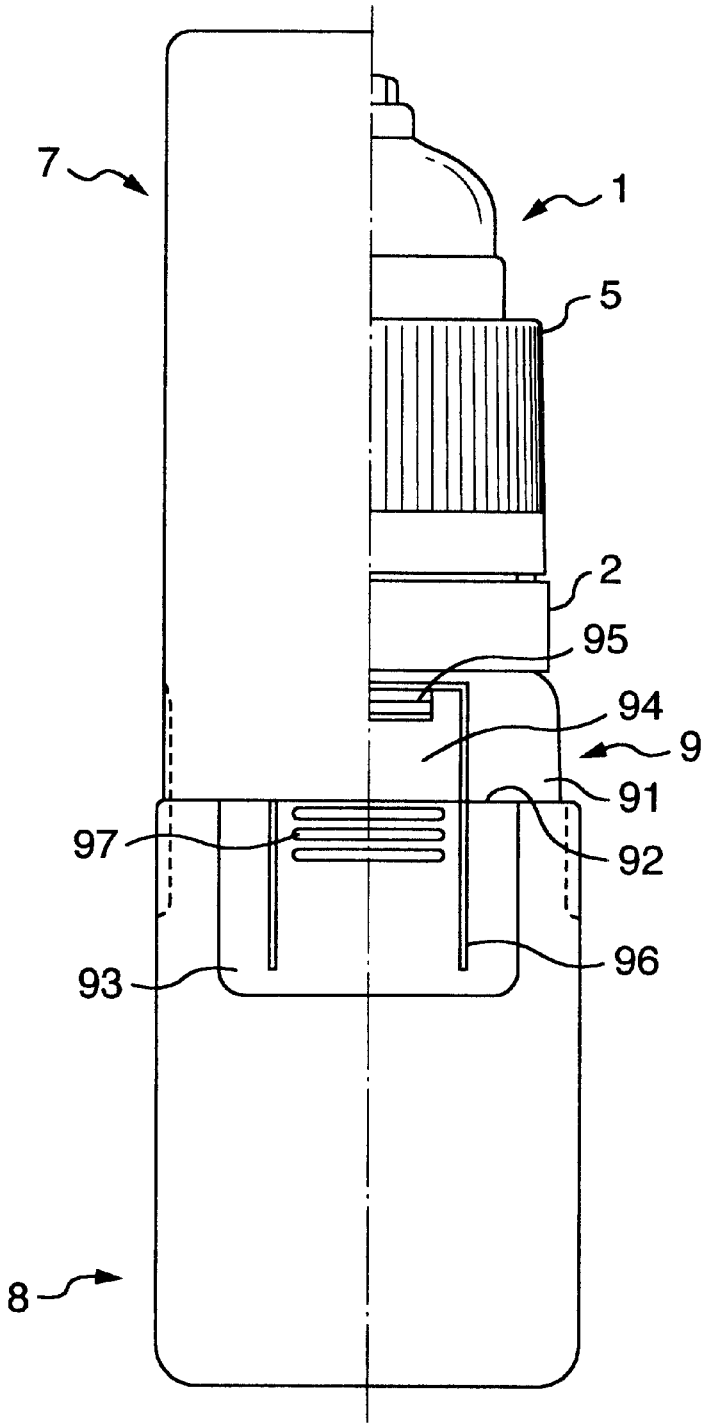
FIG. 21 is an entire side view of the embodiment shown in FIG. 20, wherein the right half of the cap unit is removed.
Figure 22:
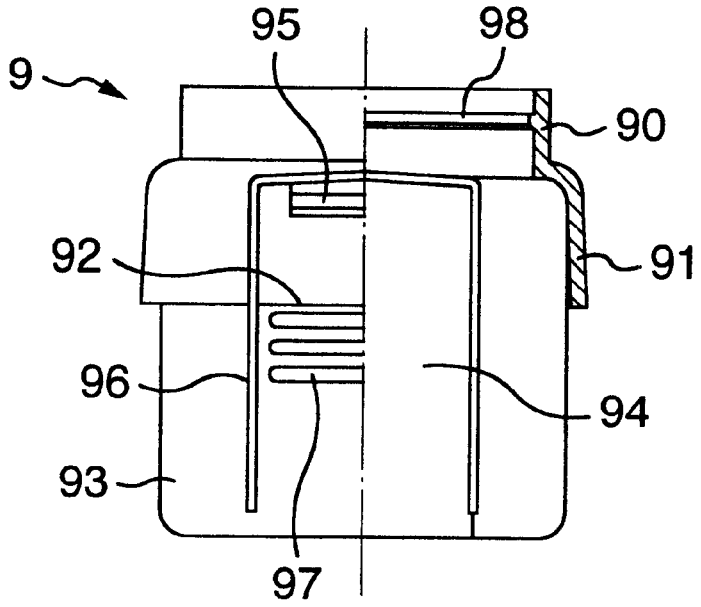
FIG. 22 is an entire side view of a cap-fitting/removing unit in the embodiment shown in FIG. 20, wherein the right half is a vertical cross-sectional view.
Figure 23:
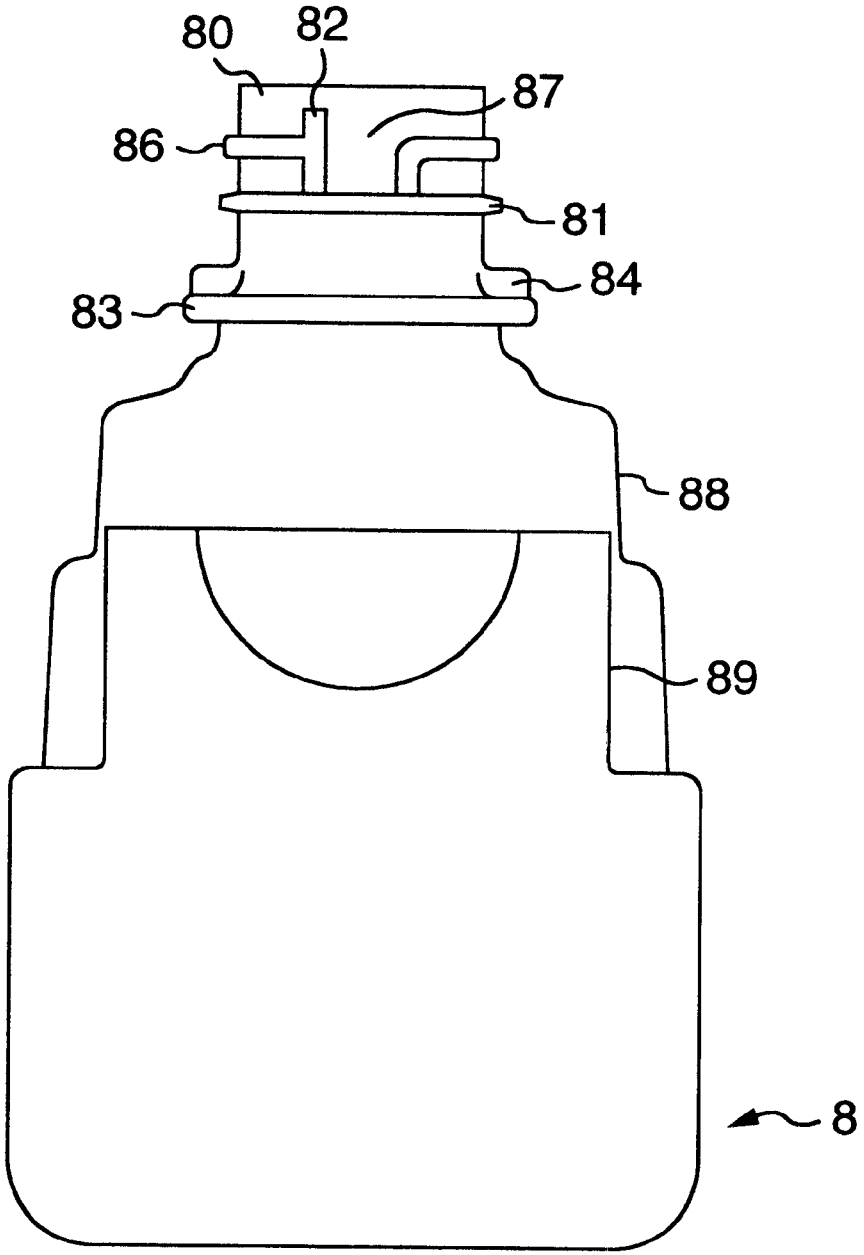
FIG. 23 is an entire front view of a bottle unit in the embodiment shown in FIG. 20.

FIGS. 17–19 show a second embodiment structured to prevent wrong opening/closing operation of the pouring out and applying stopper 1. A base tube, connected to a lower end of the attaching tube 20 of the attaching unit 2 by a connecting flange 24*c* is structured to be a skirt tube 24*a* disposed right under the operating unit 5 at its descending limit. Cutouts 24*d* are provided on portions of the skirt tube 24*a* and the connecting flange 24*c* positioned at front and rear, so that the front and rear portions of the skirt tube 24*a* are formed to be displaceable sections 24*b*, which are flexibly displaceable in the radial direction. Each of these displaceable sections 24*b* is provided with hooks 24*e*. Stoppers 58 are disposed on lower end of an inner circumference surface of the outer tube 50 of the operating unit 5. The outer tube 50 is inhibited from the ascending rotation by these stoppers which are engaged with the hooks 24*b*.

In this second embodiment, the operating unit 5 cannot be rotated for ascent due to the engagement of the stoppers 58 with the hooks 24*e*, in the measuring state, i.e., when the operating unit 5 is located at its descending limit and the pouring out mouth 55 cannot be opened. This engagement of the hooks 24*e* with the stoppers 58 is released by holding both displaceable sections 24*b* with fingers and pushing them from the front and the rear. At that time, the operating unit 5 gets into the state affording ascending rotation, and thus the pouring out and applying stopper 1 can be switched from the measuring state to the applying state.

FIGS. 12–23 show a third embodiment, in which a cap-fitting/removing unit 9 is attached to an upper portion of the bottle unit 8 so as to prevent the fitted cap unit 7 from being removed mistakenly. The cap-fitting/removing unit 9 comprises an attaching tube 90, which is fitted onto the bottle unit 8. An escape-preventing ridge 98 for engaging with an outer flange 83 of the bottle unit 8 from underside is disposed in a circumferential direction on an inner surface of the attaching tube 90. A shoulder tube portion 91 of a substantially elliptic shape is extended downwardly from a lower edge of the attaching tube 90. The shoulder tube portion 91 is fitted onto a reduced diameter attaching portion 88 of the bottle unit 8, which is formed for the cap-fitting/removing unit 9 to be attached and is a shoulder portion of the bottle unit 8, reduced in diameter. Suspended wall sections 93, which are adapted to engage with recessed sections 89 formed at upper portion of both side portions of a barrel portion of the bottle unit 8 by means of upward facing abutting steps 92, are formed at lower end edges of both side portions of the shoulder tube 91. Tongue-like wall sections 94 are formed by forming gate shape cutout grooves 96 on portions extending from the suspended wall sections 93 to the shoulder tube portions 91. The tongue-like wall sections 93 are provided with hooking ridges 95 on the upper part of an outer surface which is an end of tilting.

When the cap unit 7 is put on the bottle unit 8 to which the pouring out and applying stopper 1 is attached, the cap unit 7 is assembled to the bottle unit 8 in a state that the lower end edge thereof is in contact with the abutting steps 92 and the hooking ridges 95 are in engagement with engaging projections 71, so that the cap unit 7 cannot be removed from the bottle unit 8.

To remove the cap unit 7, the tongue-like wall sections 94, which are disposed right under the cap unit 7 and are provided with a plurality of finger applying ridges 97 on the surface thereof, are pushed to be tilted inwardly to release the engagement of the hooking ridges 95 with the engaging projections 71. In that state, the cap unit 7 is drawn up away from the bottle unit 8.

All the components of the pouring out and applying stopper 1 and the cap unit 7, including the cap-fitting/removing unit 9, are molded by utilizing synthetic resins which are adapted to the functions required for the components.

In the case of the pouring out and applying stopper 1, for example, polypropylene is a suitable material for the attaching unit 2, because of elastic deformability for the undercut engagement with the bottle unit 8 made of a hard material, maintenance of seal after the engagement, and high resistance to aging. Polypropylene is also suitable for the stopper unit 3, because this unit 3 is integrally combined with the attaching unit 2 to constitute a main part and because the sealing outer flange 31 is fitted tightly into the inner tube 45 of the switching unit 4 so as to obtain strong seal.

Since the switching unit 4 is softer than the attaching unit 2, hard polyethylene is suitable for molding material, because this material gives high sealing property through tight and slide contact and has quite low frictional resistance against polypropylene. The operating unit 5 is suitably made of polypropylene, because similarly to the attaching unit 2, the operating unit 5 is required to have a tight attaching relationship with the switching unit 4 and also because on demand, it may become necessary for the operating unit 5 to be able to have transparency. As the material for the valve unit 6, soft polyethylene can be suitably used to give high elastic recovery and high sealing performance of air-tight compartment.

The cap unit 7 is suitably made of polypropylene for easy deformation required in the engagement with the bottle unit 8 of a hard material. Polypropylene is also suitably used for the cap-fitting/removing unit 9, so as to maintain the cap shape in stable and yet to afford elastic deformation.

ADVANTAGES OF THE INVENTION

The present invention has the structure described above, and therefore, results the following advantages.

In the invention according to claim 1, the lower ends of the helical elastic elements, which constitute the valve unit to open and close the pouring out mouth, are fixed to the upper portions of the fixing plates, which have a height substantially equal to the depth of the measuring chamber. Therefore, the valve unit rarely affects the change in the capacity of the measuring chamber, even if the elements are not constant in their form of elastic deformation. This invention thus makes it possible for a precise set amount of liquid to be measured and poured out. Only by pressing down the valve head onto the surface to be applied, precise and suitable application of the contained liquid can be achieved.

Since the lower portions of the elastic elements of the valve unit, which the distance between adjacent elements becomes maximum, are fixed to the hard fixing plates, in the handling of valve units before they are installed to the vessels for pouring and applying a constant amount of liquid, it is prevented by the fixing plates that the valve heads and the like enter between the lower end portions of the elastic elements of other valve units. Therefore, tangling among the valve units is prevented and handling of valve units themselves is thus improved.

In the invention according to claim 2, since a plurality of escape-preventing pieces are disposed around the lower periphery of the switching unit in the spread state, the abutting convex portions on the inside of these escape-preventing pieces do not come into contact with the helical ridge and the stop ridge of the attaching unit during assembling of the switching unit to the attaching unit in the assembling steps of the vessels for pouring and applying a constant amount of liquid. Therefore, it is easy and smooth to attach the switching unit to the attaching unit, and there is no fear that part of the helical ridge or other ridges are deformed permanently.

These escape-preventing pieces are displaced and bent inwardly when the operating unit is fitted onto the attaching unit. Therefore, the abutting convex portions abut against the stop ridge at the ascending limit for the switching unit. Accordingly, the strong and safe escape-preventing function of the switching unit to the attaching unit can be exhibited.

In the invention according to claim 3, a sounding piece can be disposed at the lower periphery of the switching unit without fear of damage when the switching unit is attached to the attaching unit. Therefore, a highly sensitive clicking function at the ascending and descending limits for the switching unit can be afforded.

In the invention according to claim 4, the sound and feeling of click can be obtained right before the measuring state and the supplying state of the applying stopper. Therefore, it is possible to recognize correctly the state of the applying stopper and to obtain favorable sense of use.

In the invention according to claim 5, the attaching unit can be fitted onto the bottle unit at a specified position. Thus, the relationship between the front side and the rear side of the bottle unit can be aligned with that of the attaching unit surely and automatically, so that it is possible to obtain favorable and suitable handling and display.

Particularly, with respect to a bottle unit which the front and rear relationship is given by displaying the name of company or merchandise and the liquid efficacy and the like, it is possible to position an applying stopper on which the state display for use is put at a certain position along the circumference so as to adapt the state display to the front and rear relationship of the bottle unit. Accordingly, it is possible to effectively function the display on the applying stopper.

In the invention according to claim 6, since the liquid inside the measuring chamber can be visually observed, it is possible to see and confirm the measuring state of the contained liquid. Accordingly, it is possible to safely and suitably effect the pouring out and usage of the contained liquid.

In the invention according to claim 7, since the stopper unit is immovably attached to the attaching unit, during the initial period of rotational movement for switching the vessel from the measuring state to the applying state, a state is always resulted in which the valve unit is relatively rotated to the stopper unit so that they can be separated. With this state, there is no case that the valve head of the valve unit is displaced together with the stopper unit to go away from the pouring out mouth and the pouring out mouth is wrongfully opened, and a suitable and stable action of the valve unit can be obtained.

In the invention according to claim 8, the pouring out mouth is tightly closed by the valve unit when the switching from the measuring state to the applying state is under way and the bottle unit is not in the closed state. On the other hand, the bottle unit is closed whenever the pouring out mouth can be opened up by the valve unit. In this way, the liquid is not at all poured out in any amount other than the measured one, and safe pouring out operations of the contained liquid can be obtained.

In the invention according to claim 9, the vertical through hole, which has been closed by the stopper unit, is opened in the initial period of switching operation, when the applying stopper is switched from the measuring state to the applying state by rotational movement. Therefore, even if there has been a pressure difference between the inside and outside of the vessel, the difference quickly ceases through the vertical through hole. Accordingly, it is possible to prevent beforehand those accidents wherein the liquid gushes out mistakenly during the applying operation and no longer is applied smoothly or the liquid flies in all directions and makes surroundings stained.

In the invention according to claim 10, since stop function at the descending limit for the switching unit is given by the abutting step provided on the attaching unit, there is no occasion in which the valve seat is caught up at a pressure more than necessary between the lower peripheral part of the pouring out mouth of the operating unit and the sealing top surface of the stopper unit. Therefore, deformation damage and the like to the valve seat are prevented and the sealing function of the valve seat is not lost.

In the invention according to claim 11, the coupling for the ascending or descending displacement caused by the rotation of the switching unit relative to the attaching unit is achieved by the threaded engagement. Therefore, the coupling structure can be easily formed, and the operation is simplified when the switching unit is attached to the attaching unit.

In the invention according to claim 12, the coupling for the ascending or descending displacement caused by the rotation of the switching unit relative to the attaching unit is achieved by the engagement of the guide projections with the sloped guide grooves. Therefore, in the state capable of maintaining in stable the position of the switching unit relative to the attaching unit during the ascending/descending displacement, it becomes possible to set freely the ascending/descending amount with respect to the rotational amount, thereby to provide an applying stopper which is easy to operate for switching.

In the invention according to claim 13, the liquid can be smoothly and effectively applied to the surface because an opening area as the application area of contained liquid to the surface can be widened without increasing the cross-sectional area of the pouring out passage for the liquid.

In the invention according to claim 14, the erect tube of the attaching unit is given a structure in which the pushing force applied thereon is shared at three or more points equally and flexibly. Therefore, the pushing force can be supported without deviating from axial alignment, and sure and steady passing action of the contained liquid and the air through the window holes can be obtained.

In the invention according to claim 15, the attitude of assembling of the operating unit relative to the switching unit by means of an automatic assembling machine can be determined at one position along the circumference, thereby the position mark put on the surface of the operating unit can be aligned with the function mark put on the surface of the attaching unit. Thus, the function mark can be utilized effectively, and all the displays on the applying stopper can be suitably aligned with the position of the display on the bottle unit.

In the invention according to claim 16, the rotational operation of the operation unit from the measuring state, in which the applying stopper is closed, to the applying state in which the applying stopper is opened must be performed with a certain operating procedure and state to the applying stopper kept. Since those who do not know this handling procedure cannot achieve opening of the applying stopper, the applying stopper can be protected from being opened mistakenly. Accidents can be prevented beforehand even if children try to open the cock in mischief.

In the invention according to claim 17, separation of the cap unit from the bottle unit must be performed with a certain operating procedure and state to the vessel kept, thereby wrong separation of the cap unit by those who do not know the procedure and occurrence of danger due to opening of the cap unit by children's mischief can be prevented.

In the invention according to claim 18, there are provided not only smooth relative displacement among components, a high sealing ability derived from flexible response to deformation and elasticity, high productivity and mold forming ability at a low cost, but also a desired transparency depending on needs.

What is claimed is:

1. A vessel for pouring out and applying a constant amount of liquid comprising:

a bottle unit (8) having a mouth tube (80) on top thereof;

an applying stopper (1), which comprises an attaching unit (2), which is tightly and immovably attached to the mouth tube of the bottle unit and is provided with a stopper unit (3) having a sealing outer flange (31) in an open upper end of a central portion;

a switching unit (4), which is fitted tightly onto said attaching unit (2) so as to move upward and downward with a certain stroke in relative rotational movement and is provided with an inner tube (45) stood at a central portion so that said sealing outer flange (31) tightly fits into a top end opening at ascending limit for said switching unit (4);

an operating unit (5) of a cylindrical shape having a top plate, which is fitted tightly and immovably onto said switching unit (4), and is provided with a pouring out mouth (55) at an upper end, said operating unit (5) defining a measuring chamber (A) of a certain volume together with said switching unit (4); and a valve unit (6), which is provided with a valve head (61) fitted into said pouring out mouth (55) in such a manner that an upper end portion thereof can protrude from said mouth and a valve seat (64) provided around a lower end of said valve head (61) and coming into close contact with a lower end opening portion of said pouring out mouth (55), said valve unit (6) giving an upward elastic force to an integrated member of said valve seat (64) and said valve head (61); and a cap unit (7), which covers said applying stopper (1) and is removably fitted onto an upper end of a barrel portion of said bottle unit (8);

wherein said valve unit (6) further comprises a plurality of fixing plates (66) stood on a top surface of an attaching ring (60) which is immovably attached to the switching unit (4), and a plurality of helical elastic elements (65) interconnecting said fixing plates (66) and said valve seat (64), said fixing plates (66) having a height substantially the same as a depth of the measuring chamber (A).

2. A vessel for pouring out and applying a constant amount of liquid comprising:

a bottle unit (8) having a mouth tube (80) on top thereof;

an applying stopper (1), which comprises an attaching unit (2), which is tightly and immovably attached to the mouth tube of the bottle unit and is provided with a stopper unit (3) having a sealing outer flange (31) in an open upper end of a central portion;

a switching unit (4), which is fitted tightly onto said attaching unit (2) so as to move upward and downward with a certain stroke in relative rotational movement and is provided with an inner tube (45) stood at a central portion so that said sealing outer flange (31) tightly fits into a top end opening at ascending limit for said switching unit (4);

an operating unit (5) of a cylindrical shape having a top plate, which is fitted tightly and immovably onto said switching unit (4), and is provided with a pouring out mouth (55) at an upper end, said operating unit (5) defining a measuring chamber (A) of a certain volume together with said switching unit (4); and a valve unit (6), which is provided with a valve head (61) fitted into said pouring out mouth (55) in such a manner that an upper end portion thereof can protrude from said mouth and a valve seat (64) provided around a lower end of said valve head (61) and coming into close contact with a lower end opening portion of said pouring out mouth (55), said valve unit (6) giving an upward elastic force to an integrated member of said valve seat (64) and said valve head (61); and a cap unit (7), which covers said applying stopper (1) and is removably fitted onto an upper end of a barrel portion of said bottle unit (8);

wherein a plurality of escape-preventing pieces (41), inside portions of which are formed to abutting convex portions **(41*a*), connected to a lower end of said switching unit (4) through thin portions (41*b*) in such a manner that the pieces can be bent and are in a spread state, the pieces (41) being bent inwardly when the operating unit (5) is attached to said switching unit (4), and at the ascending limit, the abutting convex portions (41***a*) abutting against a stop ridge (29) on a circumference of the attaching unit (4) from underside.

3. The vessel according to claim 2, wherein at least one sounding piece (48), inside portion of which is formed to a surmountable convex portion (48*a*), is connected to the lower end of said switching unit (4) through a thin portion (48*b*) in such a manner that the piece (48) can be bent and a lower portion protrudes outwardly, the piece (48) being bent inwardly when the operating unit (5) is attached to said switching unit (4), and just before the ascending limit and just before descending limit of said switching unit (4), said surmountable convex portion (48*a*) being allowed to go over vertical ridges (29*a*) on an outer circumference of the attaching unit (2) to make a clicking sound.

4. The vessel according to claim 2, wherein a plurality of escape-preventing pieces (41), inside portions of which are formed to abutting convex portions (41*a*), are connected to a lower end of said switching unit (4) through thin portions (41*b*) and one sounding piece (48), inside portion of which is formed to a surmountable convex portion (48*a*), is connected to the lower end of said switching unit (4) through a thin portion (48*b*) in such a manner that the pieces can be bent and lower portions protrude outwardly, wherein a clicking projection (41*c*) is provided on an inside end surface of an abutting convex portion (41*a*) of one of the escape-preventing pieces (41) positioned at a position diametrically opposite to the sounding piece (48) with respect to a central axis, and wherein the escape-preventing pieces (41) and the sounding piece (48) are bent inwardly when the operating unit (5) is attached to said switching unit (4), and just before the ascending limit and just before descending limit of said switching unit (4), said surmountable convex portion (48*a*) and said clicking projection (41*c*) being allowed to go over vertical ridges (29*a*) on an outer circumference of the attaching unit (2) to make a clicking sound and clicking feeling.

5. A vessel for pouring out and applying a constant amount of liquid comprising:

a bottle unit (8) having a mouth tube (80) on top thereof;

an applying stopper (1), which comprises an attaching unit (2), which is tightly and immovably attached to the mouth tube of the bottle unit and is provided with a stopper unit (3) having a sealing outer flange (31) in an open upper end of a central portion;

a switching unit (4), which is fitted tightly onto said attaching unit (2) so as to move upward and downward with a certain stroke in relative rotational movement and is provided with an inner tube (45) stood at a central portion so that said sealing outer flange (31) tightly fits into a top end opening at ascending limit for said switching unit (4);

an operating unit (5) of a cylindrical shape having a top plate, which is fitted tightly and immovably onto said switching unit (4), and is provided with a pouring out mouth (55) at an upper end, said operating unit (5) defining a measuring chamber (A) of a certain volume together with said switching unit (4); and a valve unit (6), which is provided with a valve head (61) fitted into said pouring out mouth (55) in such a manner that an upper end portion thereof can protrude from said mouth and a valve seat (64) provided around a lower end of said valve head (61) and coming into close contact with a lower end opening portion of said pouring out mouth (55), said valve unit (6) giving an upward elastic force to an integrated member of said valve seat (64) and said valve head (61); and a cap unit (7), which covers said applying stopper (1) and is removably fitted onto an upper end of a barrel portion of said bottle unit (8);

wherein a vacant zone (87) is formed on an outer circumference surface of said mouth tube (80) at a certain position in a circumferential direction between a vertical stop ridge (82) and one end of a circumferential ridge (86), the other end of which is connected to said vertical stop ridge (82); and wherein a vertical control ridge (22) is disposed on an upper part of an inner circumference surface of an attaching tube (20) which is a main part of said attaching unit (2), said vertical control ridge (22) abutting against said vertical stop ridge (22) in the circumferential direction and against the circumferential ridge (86) from upside but fitting into said vacant zone with almost no gap when said attaching tube (20) is fitted onto said mouth tube (80).

6. A vessel for pouring out and applying a constant amount of liquid comprising:

a bottle unit (8) having a mouth tube (80) on top thereof;

an applying stopper (1), which comprises an attaching unit (2), which is tightly and immovably attached to the mouth tube of the bottle unit and is provided with a stopper unit (3) having a sealing outer flange (31) in an open upper end of a central portion;

a switching unit (4), which is fitted tightly onto said attaching unit (2) so as to move upward and downward with a certain stroke in relative rotational movement and is provided with an inner tube (45) stood at a central portion so that said sealing outer flange (31) tightly fits into a top end opening at ascending limit for said switching unit (4);

an operating unit (5) of a cylindrical shape having a top plate, which is fitted tightly and immovably onto said switching unit (4), and is provided with a pouring out mouth (55) at an upper end, said operating unit (5) defining a measuring chamber (A) of a certain volume together with said switching unit (4); and a valve unit (6), which is provided with a valve head (61) fitted into said pouring out mouth (55) in such a manner that an upper end portion thereof can protrude from said mouth and a valve seat (64) provided around a lower end of said valve head (61) and coming into close contact with a lower end opening portion of said pouring out mouth (55), said valve unit (6) giving an upward elastic force to an integrated member of said valve seat (64) and said valve head (61); and a cap unit (7), which covers said applying stopper (1) and is removably fitted onto an upper end of a barrel portion of said bottle unit (8);

wherein at least an upper tube (54) of the operating unit (5) is made transparent or translucent so that the liquid inside the measuring chamber (A) is visible from outside.

7. A vessel for pouring out and applying a constant amount of liquid comprising:

a bottle unit (8) having a mouth tube (80) on top thereof;

an applying stopper (1), which comprises an attaching unit (2), which is tightly and immovably attached to the mouth tube of the bottle unit and is provided with a stopper unit (3) having a sealing outer flange (31) in an open upper end of a central portion;

a switching unit (4), which is fitted tightly onto said attaching unit (2) so as to move upward and downward with a certain stroke in relative rotational movement and is provided with an inner tube (45) stood at a central portion so that said sealing outer flange (31) tightly fits into a top end opening at ascending limit for said switching unit (4);

an operating unit (5) of a cylindrical shape having a top plate, which is fitted tightly and immovably onto said switching unit (4), and is provided with a pouring out mouth (55) at an upper end, said operating unit (5) defining a measuring chamber (A) of a certain volume together with said switching unit (4); and a valve unit (6), which is provided with a valve head (61) fitted into said pouring out mouth (55) in such a manner that an upper end portion thereof can protrude from said mouth and a valve seat (64) provided around a lower end of said valve head (61) and coming into close contact with a lower end opening portion of said pouring out mouth (55), said valve unit (6) giving an upward elastic force to an integrated member of said valve seat (64) and said valve head (61); and a cap unit (7), which covers said applying stopper (1) and is removably fitted onto an upper end of a barrel portion of said bottle unit (8);

wherein said stopper unit (3) is immovably fixed on an upper end of an erect tube (27) which is stood to form an upper end of an opened central part of said attaching unit (2); and wherein a projected stopper piece (33), which can be inserted into a vertical hole (62) provided in said valve head (61), is stood at a center of a sealing top surface (34), which is an upper surface coming into contact with a lower surface of a valve head (61) of said valve unit (6).

8. A vessel for pouring out and applying a constant amount of liquid comprising:

a bottle unit (8) having a mouth tube (80) on top thereof;

an applying stopper (1), which comprises an attaching unit (2), which is tightly and immovably attached to the mouth tube of the bottle unit and is provided with a stopper unit (3) having a sealing outer flange (31) in an open upper end of a central portion;

a switching unit (4), which is fitted tightly onto said attaching unit (2) so as to move upward and downward with a certain stroke in relative rotational movement and is provided with an inner tube (45) stood at a central portion so that said sealing outer flange (31) tightly fits into a top end opening at ascending limit for said switching unit (4);

an operating unit (5) of a cylindrical shape having a top plate, which is fitted tightly and immovably onto said switching unit (4), and is provided with a pouring out mouth (55) at an upper end, said operating unit (5) defining a measuring chamber (A) of a certain volume together with said switching unit (4); and a valve unit (6), which is provided with a valve head (61) fitted into said pouring out mouth (55) in such a manner that an upper end portion thereof can protrude from said mouth and a valve seat (64) provided around a lower end of said valve head (61) and coming into close contact with a lower end opening portion of said pouring out mouth (55), said valve unit (6) giving an upward elastic force to an integrated member of said valve seat (64) and said valve head (61); and a cap unit (7), which covers said applying stopper (1) and is removably fitted onto an upper end of a barrel portion of said bottle unit (8);

wherein a height of a lower half of an outer circumference surface of the valve head (61) of the valve unit (6), with which a lower end part of a circumference surface of the pouring out mouth (55) of said operating unit (5) tightly and slidingly comes into contact, is set nearly equal to a movement in a direction of height of the inner tube (45) of said switching unit (4) until the inner tube (45) positioned at the descending limit tightly fits onto a sealing outer flange (31) of said stopper unit (3).

9. A vessel for pouring out and applying a constant amount of liquid comprising:

a bottle unit (8) having a mouth tube (80) on top thereof;

an applying stopper (1), which comprises an attaching unit (2), which is tightly and immovably attached to the mouth tube of the bottle unit and is provided with a stopper unit (3) having a sealing outer flange (31) in an open upper end of a central portion;

a switching unit (4), which is fitted tightly onto said attaching unit (2) so as to move upward and downward with a certain stroke in relative rotational movement and is provided with an inner tube (45) stood at a central portion so that said sealing outer flange (31) tightly fits into a top end opening at ascending limit for said switching unit (4);

an operating unit (5) of a cylindrical shape having a top plate, which is fitted tightly and immovably onto said switching unit (4), and is provided with a pouring out mouth (55) at an upper end, said operating unit (5) defining a measuring chamber (A) of a certain volume together with said switching unit (4); and a valve unit (6), which is provided with a valve head (61) fitted into said pouring out mouth (55) in such a manner that an upper end portion thereof can protrude from said mouth and a valve seat (64) provided around a lower end of said valve head (61) and coming into close contact with a lower end opening portion of said pouring out mouth (55), said valve unit (6) giving an upward elastic force to an integrated member of said valve seat (64) and said valve head (61); and a cap unit (7), which covers said applying stopper (1) and is removably fitted onto an upper end of a barrel portion of said bottle unit (8);

wherein the stopper unit (3) comprises a fitting portion (30) of a thin cylindrical shape provided with ceiling; a sealing outer flange (31) provided in a circumferential direction at a center of an outer circumference surface of said fitting portion (30); and a projected stopper piece (33) of an upright thin rod shape, which is erected from a center of a flat sealing top surface (34); and wherein a vertical hole (62) extending vertically is provided at a center of the valve head (61) of said valve unit (6) in such a manner that the vertical hole (62) forms a gap between the valve head (61) and the projected stopper piece (33) for allowing air to pass therethrough, and wherein a part of a lower surface of said valve head (61) opposite to said flat sealing top surface (34) is a flat surface which comes in tight contact with said sealing top surface (34).

10. The vessel according to claim 1, 2, 3, 4, 5, 6, 7, 8, or 9, wherein the lower surface of the valve seat (64) abuts against the sealing top surface (34) of the stopper unit (3) at the descending limit for the switching unit (4), and wherein an abutting step (23*a*), against which a part of the switching unit (4) abuts to set a descending limit for the switching unit (4), is provided at a terminal end of a part of said attaching unit (2) of an ascending/descending displacement coupling function portion due to relative rotation of the attaching unit (2) and the switching unit (4).

11. The vessel according to claim 1, 2, 3, 4, 5, 6, 7, 8, or 9, wherein ascending/descending coupling by rotational movement of the switching unit (4) relative to the attaching unit (2) comprises threaded coupling between a helical ridge (23) provided on an outer circumference surface of the attaching tube (20) of said attaching unit (2) and a helical ridge (40*a*) provided on an inner circumference surface of the main tube (40) of said switching unit (4).

12. The vessel according to claim 1, 2, 3, 4, 5, 6, 7, 8, or 9, wherein ascending/descending coupling by rotational movement of the switching unit (4) relative to the attaching unit (2) comprises engagement coupling between guide grooves (23*b*) with sloped attitude formed on an outer circumference surface of the attaching tube (20) of said attaching unit (2) and guide projection pieces (40*b*) provided on an inner circumference surface of the main tube (40) of said switching unit (4).

13. The vessel according to claim 1, 2, 3,. 4, 5, 6, 7, 8, or 9, wherein diameter of a part of discharge side of the pouring out mouth (55) of the operating unit (5) is step-likely enlarged to be formed to an enlarged diameter opening portion (57).

14. The vessel according to claim 1, 2, 3, 4, 5, 6, 7, 8, or 9, wherein three or more window holes (28) are provided on a tube wall of the erect tube (27) which is provided to form the open upper end of the central part of the attaching unit (2), said window holes (28) being provided at regular intervals in a circumferential direction and extending from an upper end to a lower end of said tube wall.

15. The vessel according to claim 1, 2, 3, 4, 5, 6, 7, 8, or 9, wherein a pair of engaging vertical grooves (42), which are opened upwardly, are provided symmetrically with respect to a central axis on the outer circumference surface of the threaded engagement main tube (40) of the switching unit (4); wherein a pair of vertical engaging ridges (51) are provided symmetrically with respect to the central axis on the inner circumference surface of the outer tube (50), which is an attaching portion of the operating unit (5) to said switching unit (4), said vertical engaging ridges (51) engaging with said pair of vertical engaging grooves (42) to make rotation of said operating unit (5) against said switching unit (4) impossible; and wherein a lower end of one of said vertical engaging ridges (51) is positioned lower than that of the other of said vertical engaging ridges.

16. A vessel for pouring out and applying a constant amount of liquid comprising:

a bottle unit (8) having a mouth tube (80) on top thereof;

an applying stopper (1), which comprises an attaching unit (2), which is tightly and immovably attached to the mouth tube of the bottle unit and is provided with a stopper unit (3) having a sealing outer flange (31) in an open upper end of a central portion;

a switching unit (4), which is fitted tightly onto said attaching unit (2) so as to move upward and downward with a certain stroke in relative rotational movement and is provided with an inner tube (45) stood at a central portion so that said sealing outer flange (31) tightly fits into a top end opening at ascending limit for said switching unit (4);

an operating unit (5) of a cylindrical shape having a top plate, which is fitted tightly and immovably onto said switching unit (4), and is provided with a pouring out mouth (55) at an upper end, said operating unit (5) defining a measuring chamber (A) of a certain volume together with said switching unit (4); and a valve unit (6), which is provided with a valve head (61) fitted into said pouring out mouth (55) in such a manner that an upper end portion thereof can protrude from said mouth and a valve seat (64) provided around a lower end of said valve head (61) and coming into close contact with a lower end opening portion of said pouring out mouth (55), said valve unit (6) giving an upward elastic force to an integrated member of said valve seat (64) and said valve head (61); and a cap unit (7), which covers said applying stopper (1) and is removably fitted onto an upper end of a barrel portion of said bottle unit (8);

wherein a skirt tube (24*a*) is connected to a lower end of the attaching tube (20) in a suspended manner, which is a main part of said attaching unit (2), through a connecting outer flange (24*a*), said skirt tube (24) being positioned right under the operating unit (5)in an exposed manner; wherein parts of said skirt tube (24*a*) are structured to be displaceable sections (24*b*) elastic deformable in a radial direction by cutouts (24*d*) extending from said skirt tube (24*a*) to said connecting outer flange (24*a*); and wherein a hook (24*e*), with which a stopper (58) projected at a lower end of an inner circumference surface of said operating unit (5) engages from the ascending rotation direction, is provided on an upper surface of each displaceable section (24*b*).

17. A vessel for pouring out and applying a constant amount of liquid comprising:

a bottle unit (8) having a mouth tube (80) on top thereof;

an applying stopper (1), which comprises an attaching unit (2), which is tightly and immovably attached to the mouth tube of the bottle unit and is provided with a stopper unit (3) having a sealing outer flange (31) in an open upper end of a central portion;

a switching unit (4), which is fitted tightly onto said attaching unit (2) so as to move upward and downward with a certain stroke in relative rotational movement and is provided with an inner tube (45) stood at a central portion so that said sealing outer flange (31) tightly fits into a top end opening at ascending limit for said switching unit (4);

an operating unit (5) of a cylindrical shape having a top plate, which is fitted tightly and immovably onto said switching unit (4), and is provided with a pouring out mouth (55) at an upper end, said operating unit (5) defining a measuring chamber (A) of a certain volume together with said switching unit (4); and a valve unit (6), which is provided with a valve head (61) fitted into said pouring out mouth (55) in such a manner that an upper end portion thereof can protrude from said mouth and a valve seat (64) provided around a lower end of said valve head (61) and coming into close contact with a lower end opening portion of said pouring out mouth (55), said valve unit (6) giving an upward elastic force to an integrated member of said valve seat (64) and said valve head (61); and a cap unit (7), which covers said applying stopper (1) and is removably fitted onto an upper end of a barrel portion of said bottle unit (8);

wherein a cap-fitting/removing unit (9) is unremovably fitted onto an upper portion of the bottle unit (8), said cap-fitting/removing unit (9) having hooking ridges (95) engaging with a lower end of an inner circumference surface of the cap unit(7) fitted onto said bottle unit (8) so as to make it impossible to remove said cap unit (7) from the bottle unit (8), said hooking ridges (95) being provided on upper end portions of tongue-like wall sections (94) exposed for the most part right under the cap unit (7) fitted on the bottle unit (8), and wherein said tongue-like wall sections (94) are structured so that upper end portions thereof can be elastically displaced in a direction in which the upper end portions come close to the bottle unit (8) by pressing operation.

18. The vessel according to claim 1, 2, 3, 4, 5, 6, 7, 8, 9, 16 or 17, wherein each of components of the applying stopper (1) and the cap unit (7) is made of synthetic resins.

* * * * *